US012742251B2

(12) United States Patent
Tyagi et al.

(10) Patent No.: US 12,742,251 B2
(45) Date of Patent: Sep. 22, 2026

(54) BIPOLAR ELECTROLYZER

(71) Applicant: VERDEEN CHEMICALS INC., Bellevue, WA (US)

(72) Inventors: Vipin Tyagi, Bellevue, WA (US); Amol Harishchandra Naik, Mumbai (IN); Nishchay Chadha, Singapore (SG)

(73) Assignee: VERDEEN CHEMICALS INC., Bellevue, WA (US)

( * ) Notice: Subject to any disclaimer, the term of this patent is extended or adjusted under 35 U.S.C. 154(b) by 565 days.

(21) Appl. No.: 18/131,359

(22) Filed: Apr. 5, 2023

(65) Prior Publication Data

US 2024/0240345 A1 Jul. 18, 2024

Related U.S. Application Data

(63) Continuation-in-part of application No. 17/886,924, filed on Aug. 12, 2022, which is a continuation-in-part of application No. 17/737,869, filed on May 5, 2022, which is a continuation-in-part of application No. 17/567,046, filed on Dec. 31, 2021.

(51) Int. Cl.

| | |
|---|---|
| ***C25C 7/02*** | (2006.01) |
| ***C25C 1/18*** | (2006.01) |
| ***C25C 7/06*** | (2006.01) |
| ***C25C 7/08*** | (2006.01) |

(52) U.S. Cl.

CPC ..... *C25C 7/02* (2013.01); *C25C 1/18* (2013.01); *C25C 7/06* (2013.01); *C25C 7/08* (2013.01)

(58) Field of Classification Search

CPC .... C25C 1/18; C25C 7/00; C25C 7/02; C25C 7/06

See application file for complete search history.

(56) References Cited

U.S. PATENT DOCUMENTS

| | | | | |
|---|---|---|---|---|
| 1,911,604 | A | 5/1933 | Callbeck | |
| 3,554,893 | A * | 1/1971 | Varda | C25C 3/08 204/244 |
| 4,414,089 | A * | 11/1983 | McMonigle | C25C 7/005 204/244 |
| 9,837,689 | B2 | 12/2017 | Clarke et al. | |
| 10,316,420 | B2 | 6/2019 | Clarke et al. | |
| 10,689,769 | B2 | 6/2020 | Clarke et al. | |
| 10,793,957 | B2 | 10/2020 | Clarke et al. | |
| 11,028,460 | B2 | 6/2021 | Clarke et al. | |

* cited by examiner

*Primary Examiner* — Ciel P Contreras

(57) ABSTRACT

Disclosed are solutions for the recovery of elemental metals at industrial scales without smelting including, for example, the recovery of near-pure lead from recycled LABs via specialized electrolytic processing. Further disclosed are new processes, innovative electrolyzer designs, and/or novel utilization of supplemental chemicals necessary for successful electrolysis of pure metal from impure forms (e.g., pure lead from lead oxides), and especially applicable for solid-state electrolysis of mixtures comprising lead paste, electrolyte, and supplemental chemicals. With particular regard to recovering near-pure lead during LAB recycling, solid-state electrolysis of mixtures comprising impure lead (e.g., lead paste) is made possible by electrolytic processing using supplemental chemicals, and made scalable to industrial levels via utilization of a vertically-arranged series of horizontal bipolar cathodes in an electrolyzer assembly.

20 Claims, 13 Drawing Sheets

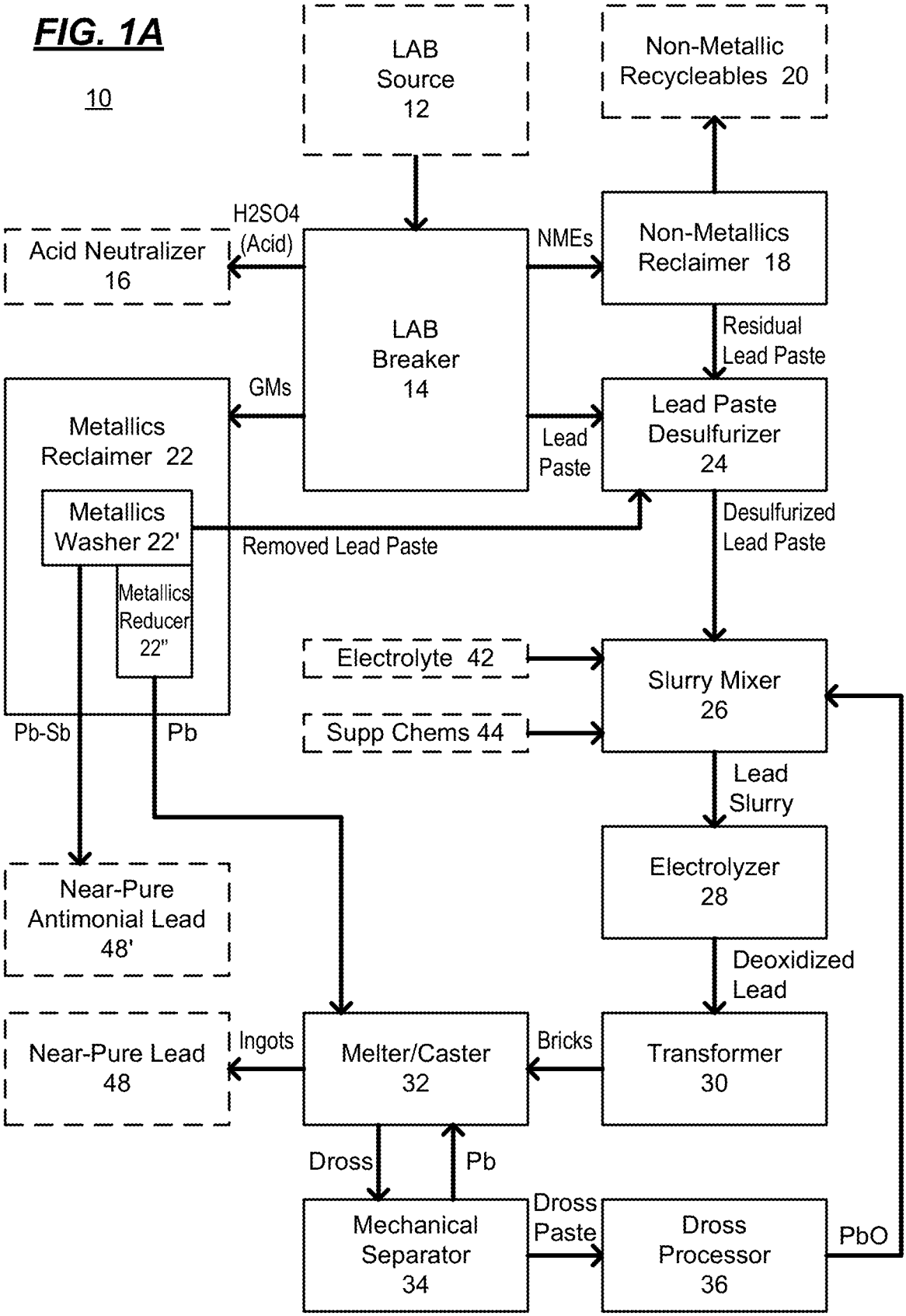
FIG. 1A
10
LAB Source 12
Non-Metallic Recycleables 20
H2SO4 (Acid)
Acid Neutralizer 16
NMEs
Non-Metallics Reclaimer 18
LAB Breaker 14
Residual Lead Paste
GMs
Metallics Reclaimer 22
Lead Paste
Lead Paste Desulfurizer 24
Metallics Washer 22'
Removed Lead Paste
Desulfurized Lead Paste
Metallics Reducer 22"
Electrolyte 42
Slurry Mixer 26
Supp Chems 44
Pb-Sb
Pb
Lead Slurry
Electrolyzer 28
Near-Pure Antimonial Lead 48'
Deoxidized Lead
Near-Pure Lead 48
Ingots
Melter/Caster 32
Bricks
Transformer 30
Dross
Pb
Mechanical Separator 34
Dross Paste
Dross Processor 36
PbO

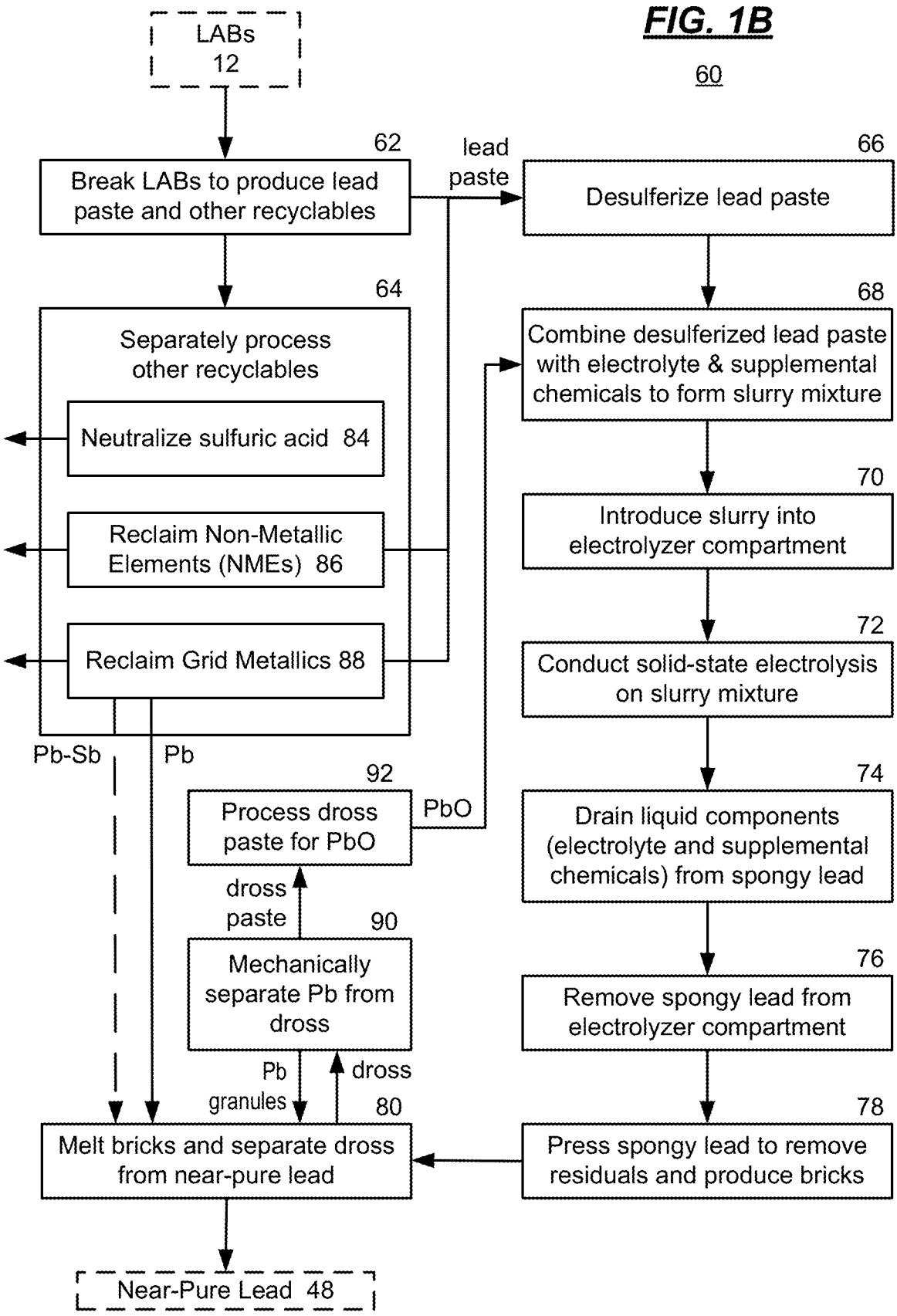
FIG. 1B
60
LABs 12
62
Break LABs to produce lead paste and other recyclables
lead paste
66
Desulferize lead paste
64
Separately process other recyclables
Neutralize sulfuric acid 84
Reclaim Non-Metallic Elements (NMEs) 86
Reclaim Grid Metallics 88
68
Combine desulferized lead paste with electrolyte & supplemental chemicals to form slurry mixture
70
Introduce slurry into electrolyzer compartment
72
Conduct solid-state electrolysis on slurry mixture
74
Drain liquid components (electrolyte and supplemental chemicals) from spongy lead
76
Remove spongy lead from electrolyzer compartment
78
Press spongy lead to remove residuals and produce bricks
Pb-Sb
Pb
92
Process dross paste for PbO
PbO
dross paste
90
Mechanically separate Pb from dross
Pb granules
dross
80
Melt bricks and separate dross from near-pure lead
Near-Pure Lead 48

FIG. 3A
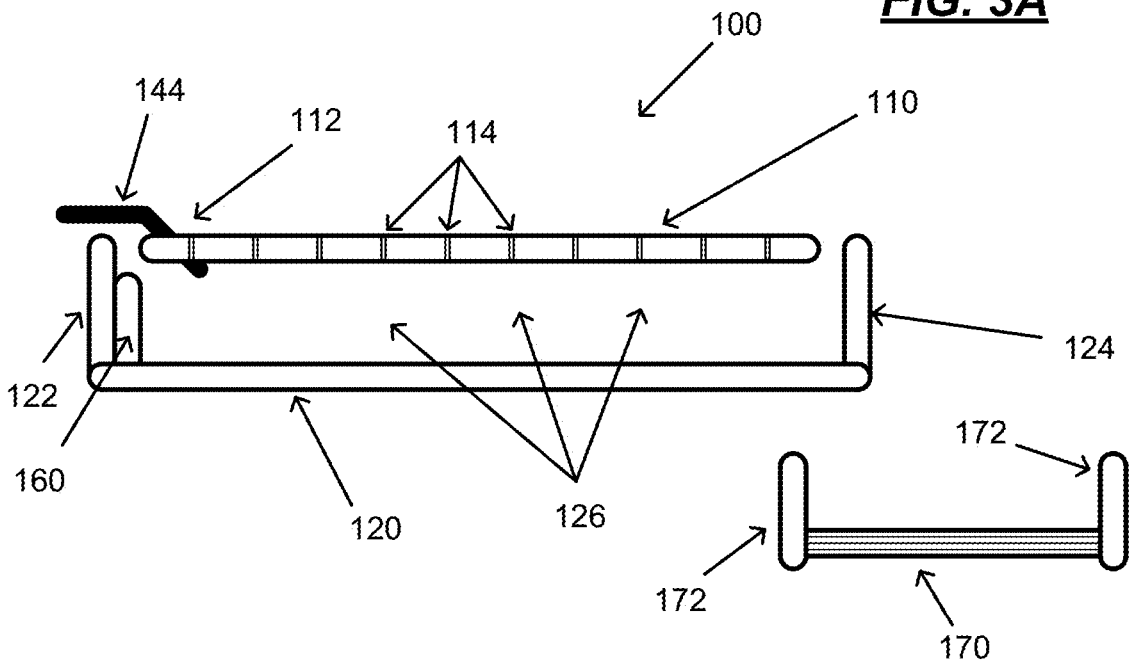
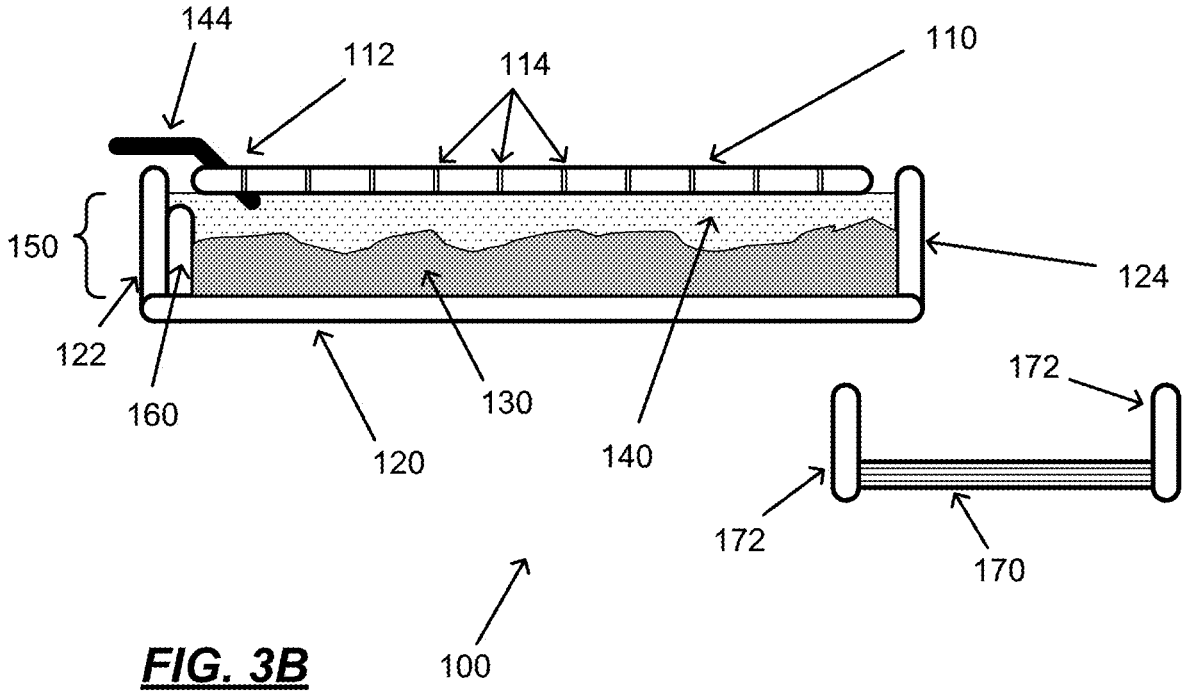
FIG. 3B

FIG. 3C
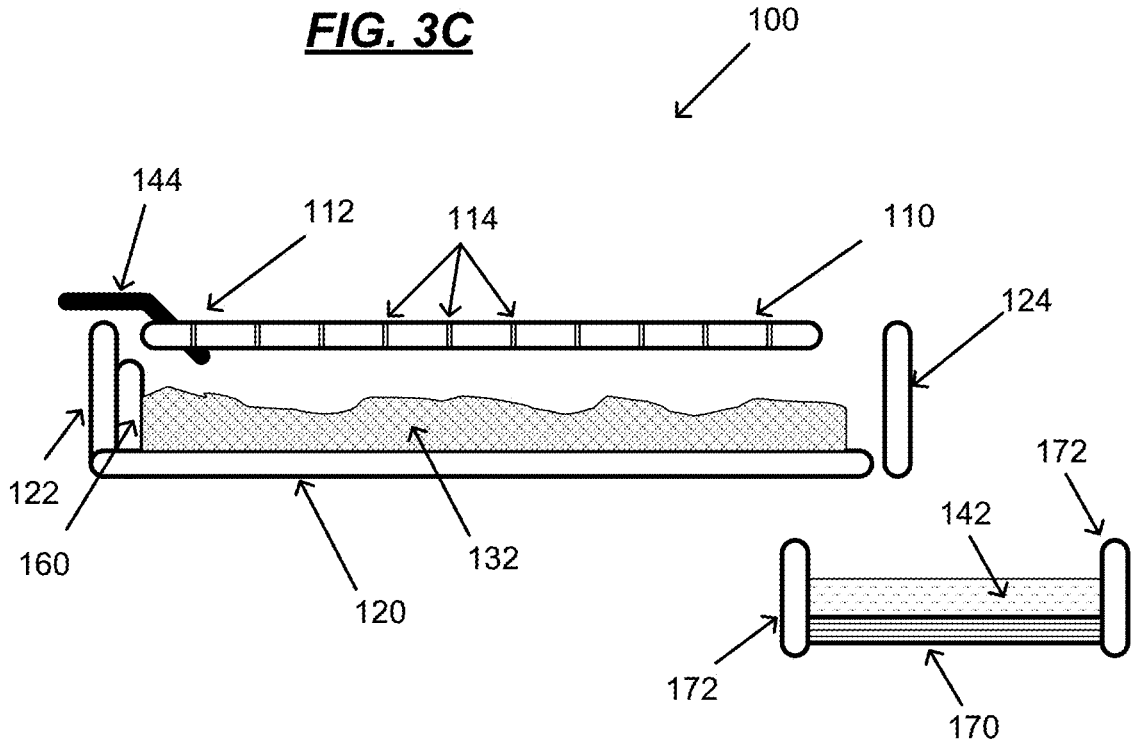
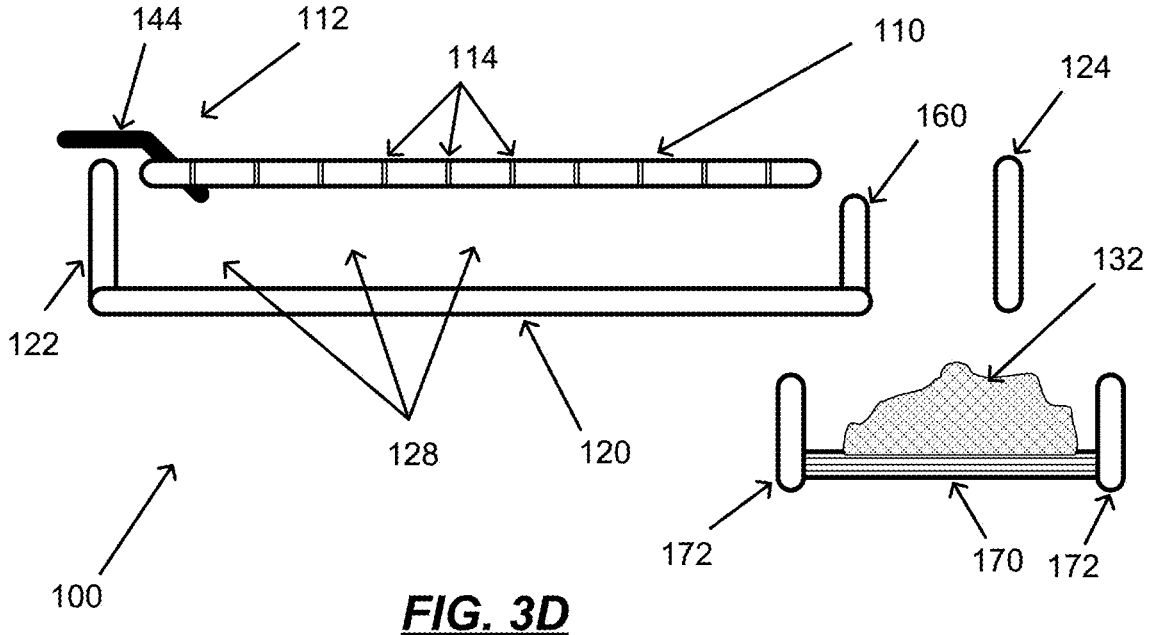
FIG. 3D

FIG. 5A
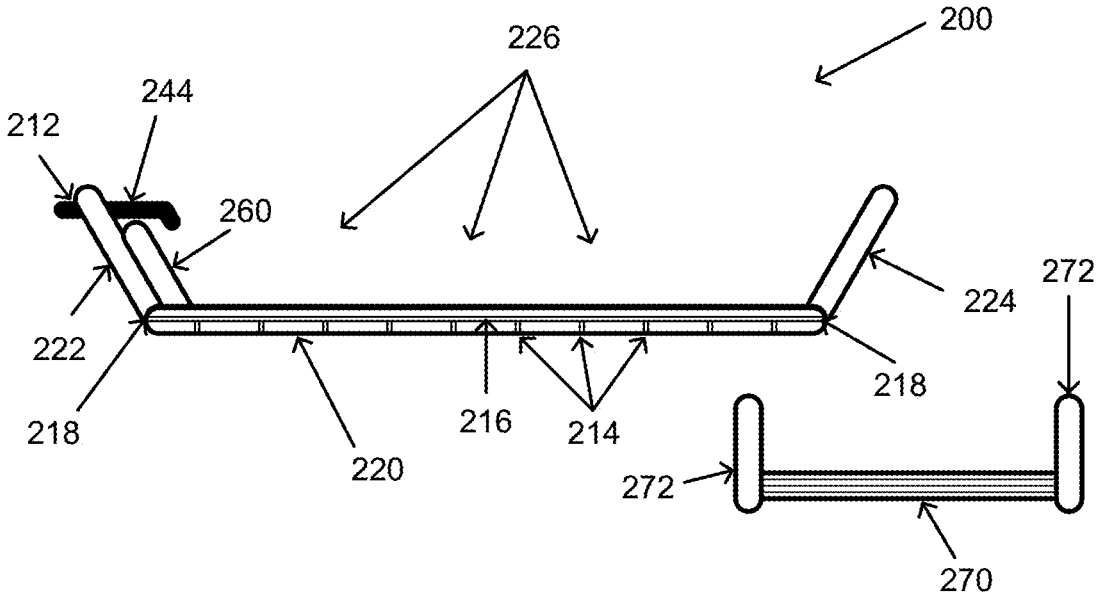
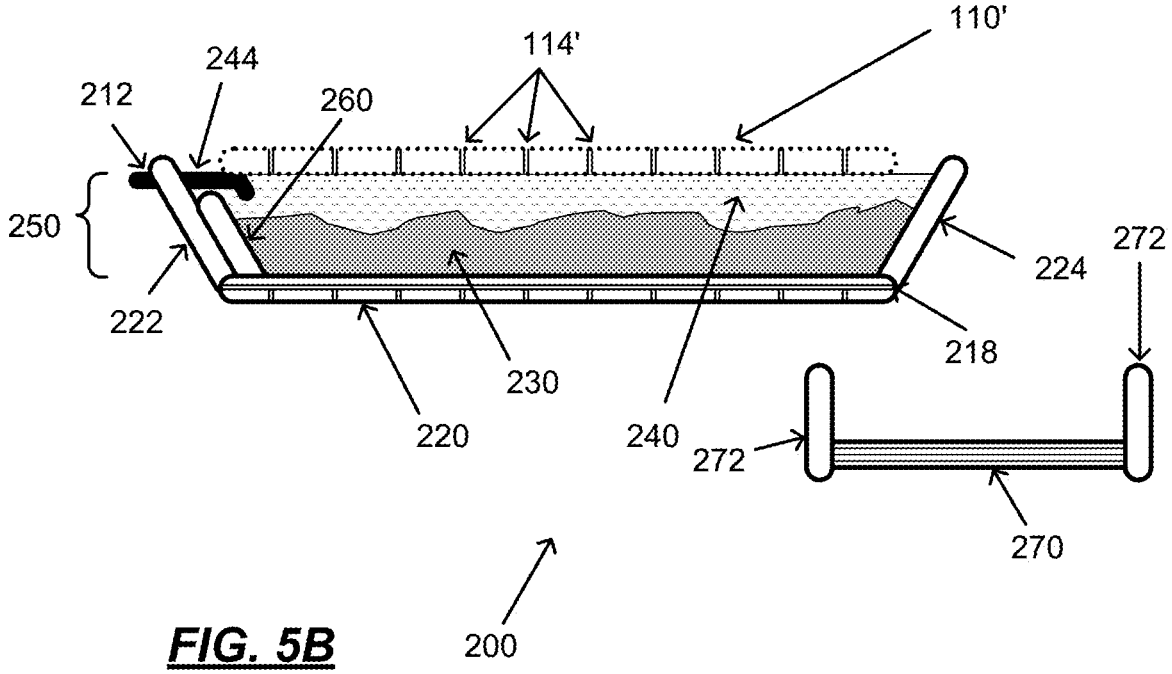
FIG. 5B

502
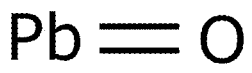
Lead Monxide
*FIG. 6A*
504
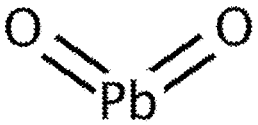
Lead Dioxide
506
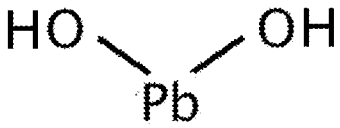
Lead Hydroxide
*FIG. 6B*
Lead Sulfate
508a
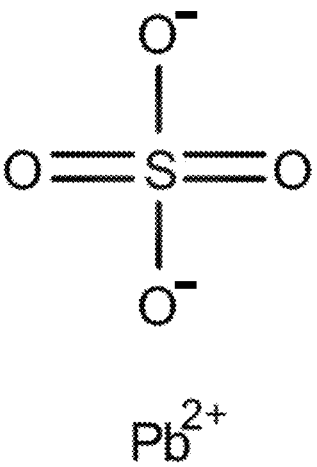
508b
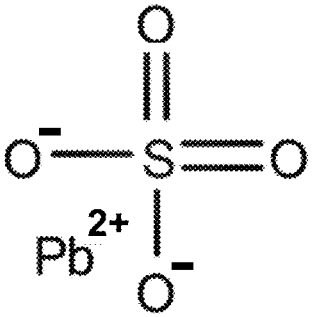

BIPOLAR ELECTROLYZER

CROSS-REFERENCE TO RELATED APPLICATIONS

This application is a continuation-in-part of, claims benefit of and priority to, and incorporates by reference herein in its entirety the following: U.S. patent application Ser. No. 17/886,924, filed Aug. 12, 2022, titled "APPARATUS FOR ELECTRO-CHEMICAL EXTRACTION OF ELEMENTAL LEAD FROM DROSS"; which in turn is a continuation-in-part of, and claims benefit of and priority to, U.S. patent application Ser. No. 17/737,869, filed May 5, 2022, titled "ELECTROLYTIC EXTRACTION OF ELEMENTAL METAL FROM METAL COMPOUNDS"; which in turn is a continuation-in-part of, and claims benefit of and priority to, U.S. patent application Ser. No. 17/567,046, filed Dec. 31, 2021, titled "ELECTROLYZER WITH HORIZONTAL CATHODE".

BACKGROUND

Lead acid batteries (LABs) are widely used today and, unlike other battery types, are almost entirely recyclable, making them the single most recycled commodity today. Recycling lead is economically important because LAB production continues to increase globally year over year, yet production of new lead is becoming increasingly difficult due to depletion of lead-rich ore deposits. However, almost all current lead recycling from LABs at industrial scale is based on smelting, a pyro-metallurgical process in which lead, lead oxides, and other lead compounds are heated to approximately 1600 degrees F. to 2200 degrees F. (900 degrees C. to 1200 degrees C.) and then mixed with various reducing agents to remove oxygen, sulfates, and other non-lead materials.

Unfortunately lead smelting is highly polluting due to its generation of significant airborne waste (e.g., lead dust, arsenic, carbon dioxide, and sulfur dioxide), solid waste (e.g., slag that contains hazardous compounds of lead and other heavy metals), and liquid waste (e.g., sulfuric acid, arsenic, and other heavy metals and their oxides). Indeed, the pollution generated from smelting is so high that it has forced the closure of many smelters in the U.S. and other western nations to protect the environment. Although migration and expansion of smelting in less regulated countries has resulted in large scale pollution and high levels of human lead contamination in those countries, similar curtailing measures are expected in those countries as time progresses and new technologies become available.

As an alternative to smelting, elemental metals like gold, silver, copper, zinc, and lead may instead be recovered from materials containing these metals by various electrolytic processes (e.g., electrolysis and its equivalents). For example, with regard to recycling lead acid batteries (LABs), the lead paste obtained therefrom—typically comprising portions of pure lead as well as lead monoxide, lead dioxide, and lead sulfate—may be dissolved with or mixed in an electrolyte and the resulting solution or mixture then subjected to electrolytic recovery of pure elemental lead (Pb) at the cathode of an electrolytic device.

Nevertheless, while conceptually simple and easily implemented on a small scale, the economic recovery of lead from battery paste via electrolytic processes on larger industrial scales as an alternative to existing approaches which require high-temperature smelting—and still yielding sufficient quantities and achieving sufficient purity while being undertaken in an environmentally-friendly manner—has heretofore been impractical and unachievable. Electrode materials for lead recovery are relatively expensive and operating conditions at the electrodes tend to promote formation of undesirable side products. In existing electrolytic approaches, insoluble lead dioxide frequently forms at the anode, limiting current flow and diminishing operational effectiveness. Likewise, lead produced at the cathode using an acidic electrolyte will deposit as a film on the cathode surface and be difficult to remove from the cathode. This deposited lead can also re-dissolve into the electrolyte when the applied electric current—that is, the electrical supply performing the electrolysis—is discontinued. Other shortcomings also exist.

Accordingly, there is a long-felt need in the art and industry for scalable, cost-effective, and environmentally-friendly solutions that enable the extraction and/or recovery of pure elemental metals from impure sources such as recovering near-pure lead (Pb) from recycled LABs.

SUMMARY

Disclosed herein are various implementations directed to an electrolyzer comprising a horizontal cathode located below a suspended anode for purposes of performing electrolysis on metal-bearing mixtures or solutions. For several such implementations, the horizontal cathode may comprise the bottom surface of a compartment for containing a mixture or solution of metal components, electrolyte, and/or supplemental chemicals; a horizontal anode for engaging the upper surface of the mixture or solution in the compartment; a gate corresponding to one sidewall of the compartment for facilitating removal of the end-products from the mixture or solution; and/or a removal mechanism for facilitating removal of the end-products of the mixture or solution from the compartment (and the surface of the horizontal cathode) through the gate. For several implementations, the electrolyzer may comprise a plurality of compartments with a plurality of horizontal cathodes oriented vertically, one above the other, and where for several such implementations the bottom surface of at least one such cathode (a "first cathode") directly or indirectly operates as an anode in conjunction with a second horizontal cathode (a "second cathode") located immediately below the first cathode. As used herein, any such cathode that also acts as an anode (for a cathode below it) being termed a "bipolar cathode" and any such electrolyzer utilizing at least one bipolar cathode being termed a "bipolar electrolyzer."

Also disclosed herein are various implementations directed to systems, methods, processes, and/or chemical compositions directed to the recovery of elemental metals at industrial scales without smelting including, for example, the recovery of near-pure lead from recycled LABs via specialized electrolytic processing utilizing any of the electrolyzers described herein, and especially with regard to the utilization of bipolar electrolyzers.

More specifically, various implementations disclosed herein are directed to an electrolyzer assembly comprising: a first bipolar electrolyzer comprising a first horizontal bipolar cathode upon which an electrolytic slurry may be emplaced for electrolysis; and a second bipolar electrolyzer comprising a second horizontal bipolar cathode, said second bipolar electrolyzer oriented vertically above the first bipolar electrolyzer such that a bottom surface of the second horizontal bipolar cathode is capable of electrically engaging an upper surface of the electrolytic slurry, said second horizontal cathode operating as an active anode for electrolysis of the electrolytic slurry. Several such implementations may further comprise one or more of the following features: wherein the first bipolar electrolyzer further comprises sloped containing surfaces for containing the electrolytic slurry upon the first horizontal bipolar cathode and permitting the second horizontal bipolar cathode to electrically engage the upper surface of the electrolytic slurry; wherein the first bipolar electrolyzer further comprises a sloped gate in the sloped containing surfaces through which an end product resulting from electrolysis can be removed from the first horizontal bi-polar cathode; wherein the first bipolar electrolyzer further comprises a removing mechanism for removing, from the horizontal cathode, an end product resulting from electrolysis; a third horizontal bipolar electrolyzer comprising a third horizontal bipolar cathode, said third bipolar electrolyzer oriented vertically above the second bipolar electrolyzer, said third horizontal cathode capable of operating as an active anode for electrolysis of a second electrolytic slurry emplaced upon the second bipolar cathode; an anode suspended above the second horizontal bipolar cathode for physically engaging a second electrolytic slurry contained by the second bipolar electrolyzer; a special electrolyzer oriented vertically below the first electrolyzer, said special electrolyzer comprising a uni-polar horizontal cathode oriented to operate with the first horizontal bipolar cathode for performing electrolysis; wherein the second bipolar electrolyzer further comprises a venting substructure through which gaseous compounds resulting from electrolysis as the active anode for the first bipolar electrolyzer may pass; a direct current electrical supply and a power controller for controlling a current during electrolysis at one or more levels at one or more time periods during electrolysis; wherein the second horizontal bipolar cathode is suspended substantially parallel to the first horizontal bipolar cathode and between 40 mm to 140 mm above the first horizontal bipolar cathode during electrolysis; further comprising a slurry line for emplacing the electrolytic slurry onto the first horizontal bipolar cathode; and/or a slurry line for emplacing the electrolytic slurry onto the first horizontal bipolar cathode.

Several alternative implementations disclosed herein are also directed to apparatus for performing electrolysis comprising: a first horizontal bipolar cathode having a surface onto which an electrolytic slurry may be emplaced for electrolysis; and a second horizontal bipolar cathode suspended above the first horizontal bipolar cathode and comprising a horizontal surface for physically engaging an upper surface of the electrolytic slurry for electrolysis in which the second horizontal bipolar cathode functions as an active anode with regard to the first horizontal bipolar cathode during electrolysis. Certain such implementations may further comprise one or more of the following features: sloped containing surfaces for containing the electrolytic slurry onto the first horizontal bipolar cathode; at least one gate in the sloped containing surfaces through which an end product resulting from electrolysis can be removed from the first horizontal bipolar cathode; a removing mechanism for removing, from the first horizontal bipolar cathode, an end product resulting from electrolysis; wherein the second horizontal bipolar cathode comprises a venting substructure through which gaseous compounds resulting from electrolysis may pass; and/or wherein the second horizontal bipolar cathode is between 40 mm and 140 mm above the first horizontal bipolar cathode during electrolysis.

Select implementations disclosed herein may instead be directed to a system for performing electrolysis on an electrolytic slurry comprising: a first horizontal bipolar cathode having a surface onto which the electrolytic slurry may be emplaced for electrolysis; and a second horizontal bipolar cathode electrically engaging the electrolytic slurry for electrolysis, the second horizontal bipolar cathode suspended above the first horizontal bipolar cathode and comprising a horizontal surface for physically engaging an upper surface of the electrolytic slurry for electrolysis, wherein the second horizontal bipolar cathode functions as an active anode with regard to the first horizontal bipolar cathode during electrolysis. For some such systems, the horizontal anode surface may comprise a venting substructure through which gaseous compounds resulting from electrolysis may pass.

This summary is provided to introduce a selection of concepts in a simplified form that are further described below in the detailed description. This summary is not intended to identify key features or essential features of the claimed subject matter, nor is it intended to be used to limit the scope of the claimed subject matter, nor is it an admission that any of the information provided herein is prior art to the implementations described herein.

BRIEF DESCRIPTION OF THE DRAWINGS

The foregoing summary and the following detailed description of illustrative implementations are better understood when read in conjunction with the appended drawings. For the purpose of illustrating the implementations, there are shown in the drawings example constructions of the implementations; however, the implementations are not limited to the specific methods and instrumentalities disclosed. In the drawings:

FIG. 1A is a modified block diagram illustrating the major components of an exemplary end-to-end electro-chemical system for reclaiming near-pure lead from LABs—and indicating directional flow of materials between various subsystems thereof—representative of various implementations disclosed herein;

FIG. 1B is a process flow diagram illustrating exemplary approach for LAB recycling using the system of FIG. 1A representative of the various implementations disclosed herein;

FIG. 3A is an illustration providing a cut-away side view of the electrolyzer cell of FIG. 2A and FIG. 2B, representative of the various implementations disclosed herein, in an initial ready-to-use configuration for conducting electrolysis;

FIG. 3B is an illustration providing a cut-away side view of the electrolyzer cell of FIG. 2A and FIG. 2B, representative of the various implementations disclosed herein, after being filled with electrolytic materials for electrolysis;

FIG. 3C is an illustration providing a cut-away side view of the electrolyzer cell of FIG. 2A and FIG. 2B, representative of the various implementations disclosed herein, after electrolysis has been performed and liquid components have been drained from the electrolyzing compartment;

FIG. 3D is an illustration providing a cut-away side view of the electrolyzer cell of FIG. 2A and FIG. 2B, representative of the various implementations disclosed herein, after the end product of the electrolysis has been scraped from the horizontal cathode surface and removed from the electrolyzing compartment;

FIG. 5A is an illustration providing a cut-away side view of a bipolar electrolyzer cell comprising a bipolar cathode, representative of the various implementations disclosed herein, shown here in an unfilled ready-to-use configuration for conducting electrolysis;

FIG. 5B is an illustration providing a cut-away side view of the bipolar electrolyzer cell comprising a bipolar cathode of FIG. 5A, representative of the various implementations disclosed herein, shown here after being filled with electrolytic materials for electrolysis;

FIG. 6A is an annotated chemical illustration of the respective molecular structures for lead monoxide (PbO), lead dioxide (PbO2), and lead hydroxide (Pb(OH)2) (collectively the "oxidized lead components" or "lead oxides");

FIG. 6B is an annotated chemical illustration of the respective molecular structures for lead sulfate (PbSO4) which, for clarity, is shown with bonding charges and without (that is, with the lead (Pb) atom collocated with the two oxygen atoms having a single bond with the sulfur atom)

DETAILED DESCRIPTION

Figure 2A:
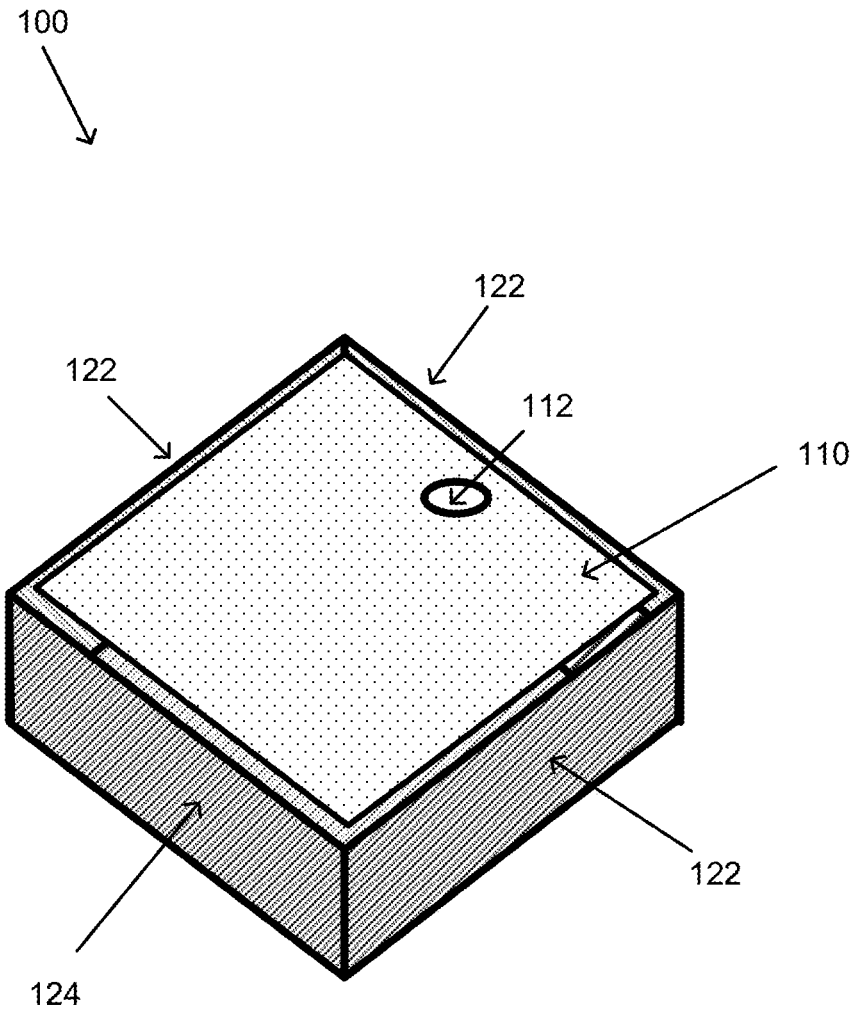
FIG. 2A is an illustration providing a perspective view of an electrolyzer cell 100 representative of various implementations disclosed herein.

The several and various implementations disclosed herein feature new processes, innovative electrolyzer designs, and/or novel utilization of supplemental chemicals necessary for successful electrolysis of pure lead from impure forms, and especially applicable for solid-state electrolysis of mixtures comprising lead paste, electrolyte, and said supplemental chemicals. With particular regard to recovering near-pure lead during LAB recycling, solid-state electrolysis of mixtures comprising impure lead (e.g., lead paste) is made possible by electrolytic processing using supplemental chemicals, and further made scalable to industrial levels via utilization of a horizontal cathode in the electrolyzer.

An understanding of various concepts is helpful toward a broader and more complete understanding of the various implementations disclosed herein, and skilled artisans will readily appreciate the implications these various concepts have on the breadth and depth of the various implementations herein disclosed. And while the several and various implementations disclosed herein may be described as specifically pertaining to or directed to use in recycling of lead acid batteries (LABs) and/or recovery of element lead therefrom without smelting, such implementations may be equally applied to the recovery of other metals and/or other metal sources. Accordingly, nothing herein is intended to limit the various implementations solely to LAB recycling or lead recovery but, instead, the various implementations disclosed herein may be applied to a variety of different electrolytic processes and electrolysis-based operations, and thus the disclosures made herein should be read as broadly as possible as applied to a variety of different metals being extracted or recovered from a variety of potentially different sources.

Furthermore, certain terms used herein may also be used interchangeably with other terms used herein, and such terms should be given the broadest interpretation possible unless explicitly noted otherwise. For example, as used herein the terms electrolysis, electrowinning, and electrorefining should be treated as interchangeable terms such that where one term is used the other terms are also implied, and thus any use of the term electrolysis should be understood to also include electrowinning and electrorefining except where explicitly differentiated. Moreover, as used herein the term "electrolytic processes" (and variations thereof) is explicitly intended to include and encompass electrolysis, electrowinning, and electrorefining, each individually and collectively.

Additionally, as will be readily appreciated and well-understood by skilled artisans, substances that might typically be represented by their chemical compositions using subscripted numbers—such as gaseous oxygen ($O_2$), water ($H_2O$), and so forth—may instead be represented herein with regular numbers in lieu of subscripted numbers (i.e., as O2 for gaseous oxygen, H2O for water, and so forth) as the same and equivalent as if subscripted numbers were utilized, and no distinction should be made as to the use of regular numbers versus the use of subscripted numbers anywhere herein.

Electrolytic Processes

As well known and readily appreciated by skilled artisans, electrolysis is a technique that uses an electrical direct current (DC) to drive an otherwise non-spontaneous chemical reaction. Using an electrolytic cell, electrolysis can be used to separate elements from one another. More specifically, in an electrolysis process an electrical current—specifically, a direct current (DC)—is passed through an electrolyte to produce chemical reactions at the electrodes and decomposition of the materials in the electrolyte.

The main components required to achieve electrolysis are an electrolyte, electrodes, and an external power source. The electrolyte is a chemical substance which contains free and mobile ions and is capable of conducting an electric current. An electrolyte may be an ion-conducting polymer, a solution, or an ionic liquid compound. For example, a liquid electrolyte may be produced by "salvation," that is, by the attraction or association of ions of solute with a solvent (such as water) to produce mobile clusters of ions and solvent molecules.

To achieve electrolysis, the electrodes (which are properly connected to a power source) are immersed in an electrolyte but separated from each other by a sufficient distance such that a current flows between them through the electrolyte with the electrolyte completing the electrical circuit. In this configuration, the electrical direct current supplied by the power source attracts ions toward the respective oppositely charged electrodes and drives the non-spontaneous reaction.

Each electrode attracts ions that are of the opposite charge: positively charged ions ("cations") move towards the electron-providing negatively-charged cathode, and negatively charged ions ("anions") move towards the electron-extracting positively-charged anode. In effect, electrons are introduced at the cathode (as a reactant) and removed at the anode (as the desired end product). The loss of electrons is referred to as oxidation, and the gain of electrons is referred to as reduction.

When neutral atoms or molecules gain or lose electrons—such as those that might be on the surface of an electrode—they become ions and may dissolve in the electrolyte and react with other ions. Conversely, when ions gain or lose electrons and become neutral, they may form compounds that separate from the electrolyte. For example, positive metal ions may deposit onto the cathode in a layer. Additionally, when ions gain or lose electrons without becoming neutral, their electronic charge is nonetheless altered in the process.

The key process of electrolysis is the interchange of atoms and ions via the addition or removal of electrons resulting from the applied electrical direct current to produce the desired end product (or multiple end products as the case may be). The desired end product of electrolysis is often in a different physical state from the electrolyte and may be removed by one of several different physical processes, such as by collecting a gaseous end product from above an electrode, by electrodeposition of the dissolved end product out of the electrolyte, or by removing solid end product buildup at one of the electrodes (e.g., scraping).

Whereas the decomposition potential of an electrolyte is the voltage needed for electrolysis to occur, the quantity of the end product derived from electrolysis is proportional to the electric current applied and, under Faraday's laws of electrolysis, when two or more electrolytic cells are connected in series to the same power source, the end product produced in the cells are proportional to their equivalent weight.

Solid-State Electrolysis

For "solid-state electrolysis," a solid metallic compound or a mixture of metallic compounds ("active material") may be reduced into a pure metal end product via electrolysis by placing the active material in direct contact with the cathode of the electrolytic cell. However, because various active materials are not naturally adhesive, placing active material onto a cathode surface (e.g., "pasting") can be problematic.

Typically active material is pasted directly onto the cathode by removing the cathode from the electrolyte in the electrolytic cell and applying a mixture of active material and electrolyte onto the cathode surface. After this mixture is allowed to dry on the cathode, the cathode is then again suspended in the electrolyte of the electrolytic cell. However, at an industrial scale of operations, pasting of active material onto a cathode surface is time-consuming and expensive due in part to the size of electrodes required for such pasting. Moreover, during electrolysis the dry-pasted active material on the cathode may absorb moisture from the electrolyte in the electrolytic cell, causing the pasted material to slough off or slide away from the cathode, and which also results in water-type electrolysis of this absorbed moisture, that together effectively substitutes for and/or precludes the desired electrolytic reaction of the active material. Additionally, it may be natural for what little end product that results to buildup at and adhere to the cathode itself, and removing this end product from the cathode may be time-consuming, inefficient, and expensive.

It is because of these inherent shortcomings that solid-state electrolysis has not been utilized for processing active materials commercially on an industrial scale, such industries opting instead for more traditional approaches for purifying active material into the desired end products such as smelting. However, as well known and widely understood by skilled artisans, smelting has its own shortcomings and thus there remains a need for an alternative purifying process and machinery for performing same on an industrial scale.

Lead Acid Battery Recycling

Lead acid batteries (LABs) are widely used today and, unlike other battery types, are almost entirely recyclable, making lead acid batteries the single most recycled item today. Recycling lead is economically important because LAB production continues to increase globally year over year, yet production of new lead is becoming increasingly difficult due to depletion of lead-rich ore deposits. However, almost all current lead recycling from LABs at industrial scale is based on smelting, a pyro-metallurgical process in which lead, lead oxides (e.g., PbO and PbO2), and other lead compounds are heated to approximately 1600 degrees F. to 2200 degrees F. (900 degrees C. to 1200 degrees C.) and then mixed with various reducing agents to remove oxygen, sulfates, and other non-lead materials.

Unfortunately lead smelting is highly polluting due to its generation of significant airborne waste (e.g., lead dust, arsenic, carbon dioxide, and sulfur dioxide), solid waste (e.g., slag that contains hazardous compounds of lead and other heavy metals), and liquid waste (e.g., sulfuric acid, arsenic, and other heavy metals and their oxides). Indeed, the pollution generated from smelting is so high that it has forced the closure of many smelters in the U.S. and other western nations to protect the environment. And although migration and expansion of smelting in less regulated countries has resulted in large scale pollution and high levels of human lead contamination in those countries, similar curtailing measures are expected in those countries as time progresses and new technologies become available.

Although numerous approaches for lead recycling from LABs are known in the art, they all suffer from one or more disadvantages that render them impractical. As such, there remains a need for improved devices and methods for scalable smelterless recycling of LABs that can achieve maximum lead recovery with minimal environmental impact and undue cost. And although some efforts have been made to move away from smelting operations and to use more environmentally friendly solutions, to date all have come up short for various reasons ranging from different pollution problems to low-yields and low-profitability to lab-type solutions that cannot be scaled up effectively or efficiently.

Electrolytic Processes

As briefly described earlier herein, elemental metals like gold, silver, copper, zinc, and lead may be recovered from materials containing these metals by various electrolytic processes (e.g., electrolysis). For example, with regard to recycling lead acid batteries (LABs), the lead paste obtained therefrom—typically comprising portions of pure lead as well as lead monoxide, lead dioxide, and lead sulfate—may be dissolved with or mixed in an electrolyte and the resulting solution or mixture then subjected to electrolytic recovery of pure elemental lead (Pb) at the cathode of an electrolytic device.

However, while conceptually simple and easily implemented on a small scale, the economic recovery of lead from battery paste via electrolytic processes on an industrial scale with sufficient yields and purity and undertaken in an environmentally-friendly manner—as an alternative to existing approaches which require high-temperature smelting—has heretofore been impractical and entirely unachievable. Electrode materials for lead recovery are relatively expensive and operating conditions at the electrodes tend to promote formation of undesirable side products. In existing electrolytic approaches, insoluble lead dioxide frequently forms at the anode, limiting current flow and diminishing operational effectiveness. Likewise, lead produced at the cathode using an acidic electrolyte will deposit as a film on the cathode surface, and this lead can be difficult to remove from the cathode. This deposited lead also re-dissolves into the electrolyte if/when the electric current—that is, the electrical supply performing the electrolysis—is discontinued. Other shortcomings also exist.

Accordingly, there is a long-felt need in the art and industry for scalable, cost-effective, and environmentally-friendly solutions that would enable the extraction and/or recovery of pure elemental metals from impure sources, such as recovering near-pure lead (Pb) during LAB recycling.

As used herein (both heretofore and hereafter), the term "near-pure" shall mean a purity comparable to within 90% of the average purity obtainable by traditional smelting processes. Likewise, the term "pure" shall mean a purity that is equal to or exceeds the typical purity level obtainable by traditional smelting processes, and the term "perfect purity" shall mean a purity that is 99.000% comprised of the elemental metal without regard to natural surface oxidation or hydroxidation. Accordingly, for all implementations disclosed herein for obtaining "near-pure" metal, such disclosures should be deemed to also disclose alternative implementations for obtaining "pure" and "perfectly pure" metals as well. Also, as used herein, the term "recovery" and other equivalent terms (e.g., purification, derivation, etc.) shall refer to the obtaining of a purer metal (e.g., elemental lead) from a less pure form of said metal (e.g., lead oxides) via electrolysis or other electrolytic processes.

FIG. 1A is a modified block diagram illustrating the major components of an exemplary end-to-end electro-chemical system 10 for reclaiming near-pure lead from LABs—and indicating directional flow of materials between various subsystems thereof—representative of various implementations disclosed herein.

In FIG. 1A, LABs designated for recycling may be provided by an LAB source 12 (shown using dotted lines to indicate an input or output with regard to the system) to the LAB breaker 14 where the LABs may be physically reduced and divided into five main components: battery acid (when present), plastics, metallics, separators, and lead paste. The battery acid, which is typically sulfuric acid ($H_2SO_4$), may then be outputted to an acid neutralizer 16 for further processing, although this operation may not be necessary (and thus optional) when the LABs provided by the LAB source 12 have already had the battery acid removed or the acid is not otherwise present. Lead paste directly recovered during LAB breaking at the LAB breaker 14 may be directed to a lead paste desulfurizer 24. Additionally, the plastics and separators may be further processed by a non-metallics reclaimer (NMR) 18 to remove (or "wash") lead residue (typically lead monoxide) adhering to the surface of these non-metallic elements (NMEs)—comprising the broken plastics and separators—before outputting the NMEs lead-free (or near-lead-free) as non-metallic recycleables 20 and separately directing the residual lead paste recovered from the NMEs to the lead paste desulfurizer 24.

Meanwhile, the metallics—or "grid metallics" (GMs) which were the electrodes from the battery—may comprise a metallic frame ("grid") coated with a special lead-based paste ("grid paste" or just "paste"), the former being constructed from a relatively rigid electro-conductive lead alloy (e.g., antimonial lead) while the latter typically comprises lead oxides and lead sulfates coated over the exposed surfaces of the lead-alloy grid. After breaking at the LAB breaker 14, the GMs may be directed to a metallics reclaimer 22 which in turn may comprise a metallics washer 22' for physically separating the lead-based paste from the lead alloy grid and directing the removed lead paste to the lead paste desulfurizer 24. The now clean grid comprising an antimonial lead alloy (Pb—Sb) may also be outputted by the metallics washer 22' as near-pure antimonial lead 48' for reuse or recycling (and, although not shown, for certain implementations this near-pure antimonial lead may be melted and caste into ingots by the melter/caster 32 discussed later herein.) Alternatively, the metallics reclaimer 22 may further comprise a metallics reducer 22" and the antimonial lead might be separated by known processes into near-pure lead and near-pure antimony, the former of which may be directed to the melter/caster 32 (discussed later herein) while the latter may be output for reuse or recycling (not shown).

The lead received by the lead paste desulfurizer 24 from the LAB breaker 14, the non-metallics reclaimer 18, and/or the metallics washer 22' of the metallics reclaimer 22 may comprise elemental lead (Pb), lead monoxide (PbO), and lead dioxide ($PbO_2$), as well as lead sulfate ($PbSO_4$) and various other substances or impurities. The lead paste desulfurizer 24 treats this received lead paste to remove the sulfur from the lead sulfate ($PbSO_4$), sulfur being a highly-damaging environmental pollutant. This desulfurization may be accomplished by the introduction of sodium hydroxide (NaOH) into the lead paste to chemically transform the lead sulfate ($PbSO_4$) into lead hydroxide ($Pb(OH)_2$) and the sodium hydroxide (NaOH) into sodium sulfate ($Na_2SO_4$), the sodium sulfate ($Na_2SO_4$) then being removed from the paste by the lead paste desulfurizer 24 utilizing any of various means known and appreciated by skilled artisans. In addition, barium sulfate ($BaSO_4$) may also be added to the lead paste prior to or during the desulfurization process as an additive where the barium sulfate—which does not react with the sodium hydroxide (NaOH) during desulfurization—is intentionally retained in the resultant (and otherwise "desulfurized") lead paste in anticipation of being later removed by subsequent subsystems. As such, the desulfurization accomplished by the lead paste desulfurizer 24 intentionally removes only the sulfur from the lead sulfate ($PbSO_4$) but not from any added barium sulfate ($BaSO_4$). As such, the desulfurized lead paste—now comprising metallic lead only in the forms of elemental lead (Pb), lead monoxide (PbO), lead dioxide ($PbO_2$), and lead hydroxide ($Pb(OH)_2$)—may then be passed to the slurry mixer 26 where the desulfurized lead paste is combined with an electrolyte 42 and supplemental chemicals 44 (discussed in more detail later herein) to form a lead slurry solution or mixture. For the various implementations herein disclosed, sodium hydroxide (NaOH) may be used as the electrolyte for subsequent electrolytic processing (e.g., electrolysis) of the lead paste, in which case the resultant lead slurry would be a mixture of the desulfurized lead paste and the electrolyte (and not a solution thereof in the chemical sense).

After mixing by the slurry mixer 26 is completed, the lead slurry may then be transferred from the slurry mixer 26 to the electrolyzer 28 for electrolytic processing (described in more detail later herein). The electrolyzer 28 then operates to produce substantially deoxidized elemental lead (Pb) from the lead monoxide (PbO), lead dioxide (PbO2), and lead hydroxide (Pb(OH)2) found in the lead slurry. The resultant deoxidized lead may then be transferred to the transformer 30 for transformation into solid bricks having minimal amounts of the electrolyte and/or the supplemental chemicals. For lead slurry mixtures (but not solutions), much of the electrolyte and/or supplemental chemicals may be drawn off by the electrolyzer 28 before being transferred to the transformer 30, and/or the transformer may comprise physical pressing of the deoxidized lead into solid bricks, said pressing also being effective in removing much of the residual electrolyte and/or supplemental chemicals. For lead slurry solutions, on the other hand, the transformer 30 might instead precipitate the deoxidized lead and thereby separate it from the electrolyte and supplemental chemicals before then pressing it into bricks.

The lead bricks—which may still have some minimal amount of electrolyte, supplemental chemicals and other impurities including but not limited to barium sulfate (BaSO4), oxidized lead (lead monoxide, lead dioxide, and/or lead hydroxide), as well as any new natural oxidation occurring on the surface of the bricks—are then sent to the melter/caster 32 for melting down, drawing off dross, and casting as output ingots of near-pure lead 48. This melting and casting may also include as input the lead reclaimed by the metallics reclaimer 22 described earlier herein. The dross, on the other hand, may be passed to a mechanical separator 34 to separate elemental lead (Pb) for subsequent return to the melter/caster 32, and lead monoxide (PbO) for return to the slurry mixer 26 and inclusion in the next mix of lead slurry for subsequent processing. For select implementations the barium sulfate (BaSO4), electrolyte, and supplemental chemicals (and remnants thereof) may be recovered at various points in the system and/or reused (not shown).

Notably, for certain other alternative implementations of the system 10, lead paste may instead be provided directly to the system, that is, either to the lead paste desulfurizer 24 if not yet desulfurized or to the slurry mixer 26 if already desulfurized (that is, having no lead sulfate (PbSO4) but still comprising barium sulfate (BaSO4) as explained above). Likewise, for certain alternative implementations of the system 10, the plastics, metallics, separators, and lead paste may be provided to the system 10, directly and/or separately, already in broken form, by one or more separate or alternative input sources (not shown) in lieu of the LAB source 12, in which case such inputs may bypass the LAB breaker 14 and proceed to the appropriate other subsystem(s) accordingly.

For certain other alternative implementations of the system 10, instead of desulfurizing the impure metal material prior to combining the impure metal material with the electrolyte to form the slurry, sulfur-containing impure metal material may be combined with the electrolyte to form a sulfur-containing slurry, and the electrolyzer itself may be utilized to desulfurize the impure metal material prior to or during the aforementioned electrolysis. For example, this additional functionality for the electrolyzer may be achieved through the consumption of stoichiometric caustic included in the electrolyte and causing in situ generation of sodium sulfate which is separable from the resultant deoxided lead in subsequent processing.

FIG. 1B is a process flow diagram 60 illustrating an exemplary approach for LAB recycling using the system 10 of FIG. 1A representative of the various implementations disclosed herein. In FIG. 1B, at 62 LABs 12 received for recycling may be broken to produce lead paste and other recyclable, the latter of which may be separately processed at 64 as generally described earlier herein with regard to FIG. 1A and further described later herein. Any additional lead recovered from this separate processing may be returned and combined with the lead paste directly resulting from the breaking at 62.

At 66 the lead paste derived at 62 (and 64 if any) may then be desulfurized—such as by treating with sodium hydroxide (NaOH), potassium hydroxide (KOH), ammonium hydroxide (NH4OH) or aqueous solution of ammonia, or other suitable chemicals—such that the resulting desulfurized lead paste substantially comprises sulfur-free lead components, e.g., Pb, PbO, PbO2, and Pb(OH)2) but no lead sulfate (PbSO4). At 68 the desulfurized lead paste may be combined with an electrolyte and supplemental chemicals to form a slurry mixture (or, in alternative implementations, a slurry solution). At 70, this slurry is then introduced into an electrolyzer cell and, at 72, solid-state electrolysis (or, in alternative implementations, typical solution-based electrolysis) may be performed.

Once electrolysis is complete, at 74 the liquid components (which may include supplemental chemicals or remnants thereof) may then be drained and, at 76, the remaining solid components resulting from the electrolysis—which may be in the form of "spongy lead" solids permeated with residual liquid components and other minor impurities—may also be removed from the electrolyzer cell. For certain alternative implementations, the liquid components and solid components may be removed from the electrolyzer cell simultaneously. At 78 the "spongy lead" solid components—which now substantially comprise pure lead (Pb)—may be pressed to remove nearly all remaining liquid components ("residuals") and form substantially pure lead bricks. At 80 the lead bricks may then be melted to eliminate nearly all remaining trace amounts of non-lead components and other minor impurities-said melting occurring at temperatures far below those required for smelting—to further purify the lead bricks and form near-pure lead 48 as ingots for output.

Notably, elements 70-76 of FIG. 1B—comprising the "electrolytic process group" (EPG) in the figure—are performed utilizing the various implementations of an electrolytic cell described in greater detail later herein, although nothing herein limits utilization of such implementations to lead recycling or to just this portion of a lead recycling process; on the contrary, other additional utilizations of the EPG are anticipated by such implementations. For example, for various implementations disclosed herein the EPG may be used to further process dross removed during the melting 80 (as briefly described with regard to FIG. 1A earlier herein).

Meanwhile, as for separately processing the other recyclables at 64, at 84 the battery acid—which is typically sulfuric acid (H2SO4)—may be neutralized and outputted from the system. At 86 the NMEs may be washed and outputted from the system with any residual lead paste (typically lead monoxide) recovered therefrom being combined with other lead paste for desulfurization at 66. At 88 the lead alloy components of the metallics (which may comprise of lead antimony) are divested of lead-based grid paste with the removed lead paste being combined with other lead paste for desulfurization at 66 while the lead antimony may be outputted from the system for reuse or recycling or, for certain alternative and optional implementations (denoted by the broken-line arrow), the lead antimony (Pb—Sb) may be melted and output at 80 as near-pure lead antimony for reuse or recycling in its alloy form (said melting performed separately from melting lead bricks when using the same melter). For other alternative implementations, at 88 the lead alloy may be separated into elemental lead (Pb) and elemental antimony (using known processes) with the resultant elemental lead (Pb) being combined with other lead for melting at 80 while the resultant antimony may be separately output for reuse or recycling.

Also shown in FIG. 1B is how the dross that results from the melting at 80 can have elemental lead (Pb) that adheres to the dross be mechanically separated (i.e., physically removed) at 90 and returned for re-melting at 80. Meanwhile, at 92 the dross paste comprising lead monoxide (PbO) and various impurities may be further processed to remove the impurities and return the lead monoxide (PbO) to a subsequent batch of combining at 68, that is, combining the resultant lead monoxide (PbO) with a subsequent batch of desulfurized lead paste at 68 for re-processing with that subsequent batch. For convenience, FIG. 1A and FIG. 1B may be collectively referred to herein as FIG. 1.

Electrolyzer Cell with Horizontal Cathode

Disclosed herein is an electrolyzer cell comprising a horizontal cathode over which a horizontal anode is suspended. The horizontal cathode may form the base of an electrolyzer compartment into which a mixture of active material and electrolyte—in the form of a slurry, for example—may be introduced, held, and processed. The horizontal anode may be suspended above the cathode in the upper portion of the electrolyzer compartment in such a manner that the anode would physically engage the upper surface of the mixture of active material and electrolyte being held by the electrolyzer compartment while the cathode would naturally engage the bottom surface of the mixture of active material being held in the electrolyzer compartment. The anode may also comprise small openings in the form of vents, trenches, holes, or the like (which may be referred to herein simply as "breathing holes") across the surface of the anode in order to allow gaseous oxygen (O2) and/or other gaseous substances resulting from the electrolysis to harmlessly escape (instead of being trapped under said anode and creating current resistance).

Accordingly, various implementations disclosed herein may be directed to and/or make use of an electrolyzer comprising a horizontal cathode located below a suspended anode for purposes of performing electrolysis on metal-bearing mixtures or solutions. For several such implementations, the horizontal cathode may comprise the bottom surface of a compartment for containing a mixture or solution of metal components, electrolyte, and/or supplemental chemicals; a horizontal anode for engaging the upper surface of the mixture or solution in the compartment; a gate corresponding to one sidewall of the compartment for facilitating removal of the end-products from the mixture or solution; and/or a removal mechanism for facilitating removal of the end-products of the mixture or solution from the compartment (and the surface of the horizontal cathode) through the gate. Certain implementations disclosed herein are specifically directed to use in recycling of lead acid batteries (LABs) without smelting, although nothing herein is intended to limit the various implementations solely to LAB recycling or lead recovery and, instead, the various implementations disclosed herein may be applied to a variety of different electrolysis operations.

For these various implementations—and in combination with use of additional supplemental chemicals added to the slurry mixture of active material and electrolyte (discussed further below)—an electrical DC current may then be passed from the cathode to the anode through the mixture of active material and electrolyte to produce the desired end product and cause that desired end product to settle on the surface of the cathode. (For certain such implementations, the end product may be pure lead in a spongy form that retains some of the electrolyte and/or supplemental chemicals.) More specifically, the electrical DC current would effectively cause the reduction of metal ions in the active material to disassociate from their counter ion—such as oxide and hydrogen ions which in turn may form water (H2O) and gaseous oxygen (O2)—and the metal, now in its pure form, would then be drawn to and settle upon the horizontal cathode surface due in part to gravity (the metal being heavier than other components in the slurry) and aided in part by the natural ionic convection that occurs in the mixture during electrolysis.

Once the electrolysis is complete, and for several such implementations herein disclosed, the electrolyzer compartment may further comprise an openable side for removing the electrolyte (including the supplemental chemicals and the additional H2O produced during the electrolysis) as well as the end-product metal. Initially this openable side may be only partially opened in order to first permit the purely liquid components—i.e., much of the remaining electrolyte, supplemental chemicals, and the additional water (H2O) produced during the electrolysis—to exit the electrolyzer compartment and, for certain implementations, be channeled away via a small channeling gutter at the base of the openable side. In some implementations, this channeling gutter may then be moved to a storage position away from the openable side (e.g., to below the electrolyzer compartment) after the liquid components have been drained through the openable side of the electrolyzer compartment.

After the liquid components have been drained away—or, in alternative implementations, without first draining the liquid components separately—the openable side may be fully opened to permit the more solid components—namely the end-product metal plus any residual liquid components adhering thereto—to be physically removed from the electrolyzer compartment. For select implementations, the removal may be performed by a vertically-oriented scraping mechanism extending across the width of the electrolyzer compartment and originating on the side opposite the openable side, said scraping component physically contacting and gently scraping the entire cathode surface and adjoining sides of the electrolyzer compartment but operating just below (and without physically contacting) the anode surface. In this manner, the scraping mechanism may operate to push the more solid components out of the electrolyzer compartment and into a collecting receptacle or onto a conveying mechanism (e.g., a conveyor belt) for further processing.

In this manner, the various implementations disclosed herein may overcome the shortcomings in existing approaches to solid-state electrolysis described above as follows: (1) there would be no need to dry-paste the active material to the cathode, saving time and effort; (2) the build-up of absorbed water by the dry-pasted active material during electrolysis—and the interference with the production of the desired end product that results-could be avoided altogether; and/or (3) the buildup of the end product at the cathode would be easier to remove as the flat surface of the cathode facilitates the scraping action (described above) and the supplemental chemicals may help prevent solidification of the end product or adhesion of the end product to the cathode.

Furthermore, for various implementations disclosed herein, multiple electrolyzer cells of the type described herein can be stacked vertically, with appropriate spacing between each electrolyzer cell, which might share a single vertical drop space for the end product pushed out of the multiple electrolyzer cells in a single collecting receptacle or onto a single conveying mechanism. Additionally, several vertical stacks comprising multiple electrolyzer cells can be arranged in a row and further share a single elongated collecting receptacle or a single elongated conveying mechanism. Moreover, multiple rows of vertical stacks can also be arranged with the produced end product being consolidated for continued processing.

Notably, separate from the disclosures made herein, Applicant has discovered that achieving the electrolytic effects described herein is dependent upon the utilization of certain specific chemicals mixed into the slurry along with the electrolyte and active materials. Although the present application is not directed to the composition of any of the these discovered chemicals, the various implementations disclosed herein are in no way limited to the use of any specific chemical additives regardless of whether secret or proprietary (or widely used and well known for that matter).

Figure 2B:
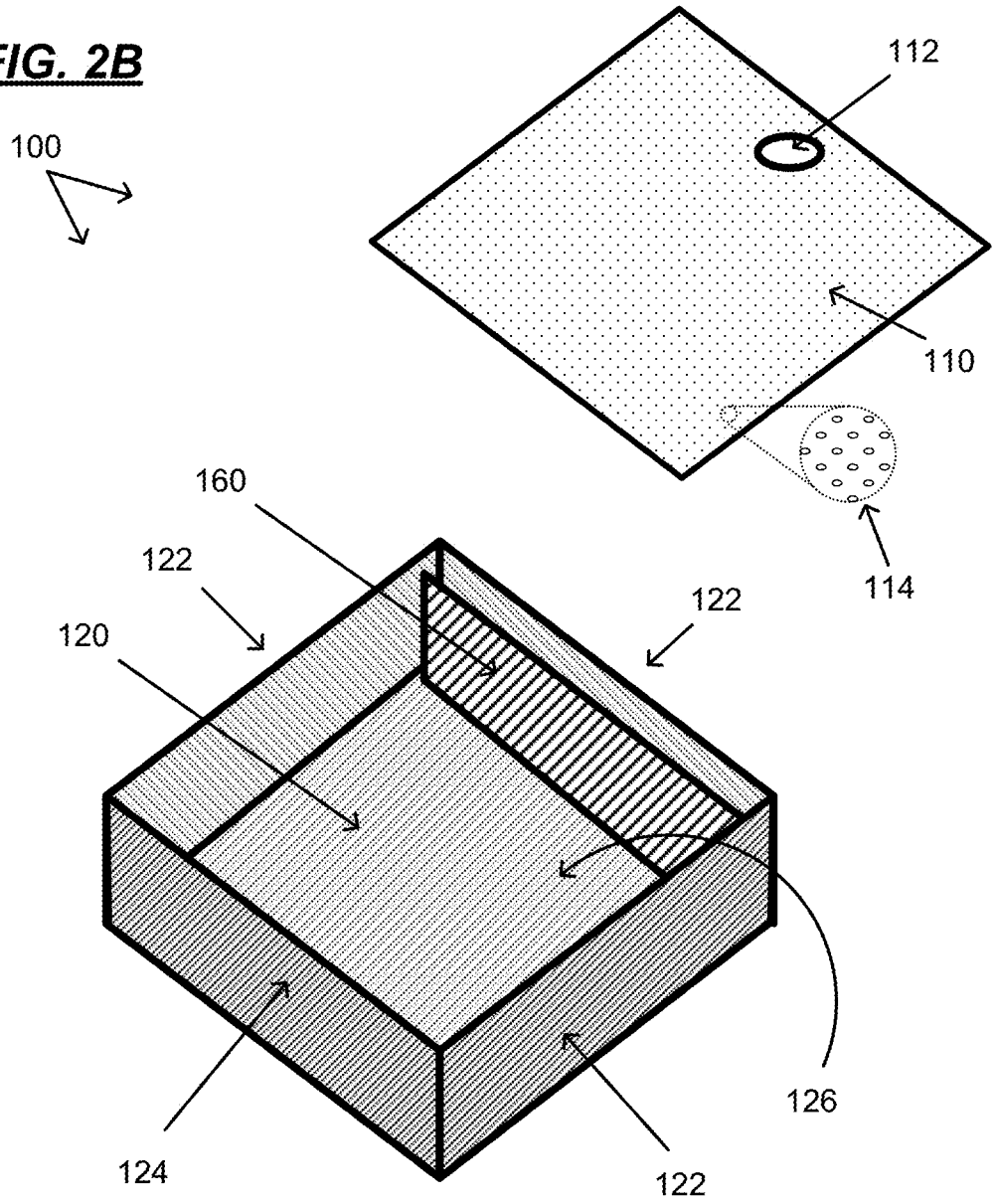
FIG. 2B is an illustration providing a blown-out perspective view of the anode and the interior of the electrolyzer cell of FIG. 2A representative of various implementations disclosed herein.

FIG. 2A is an illustration providing a perspective view of an electrolyzer cell 100 representative of various implementations disclosed herein. FIG. 2B is an illustration providing a blown-out perspective view of the anode 110 and the interior of the electrolyzer cell 100 of FIG. 2A representative of various implementations disclosed herein. For convenience, FIG. 2A and FIG. 2B may be referred to herein collectively as FIG. 2.

As illustrated in FIG. 2, an electrolyzer cell 100 may comprise an anode 110 suspended above a horizontal cathode 120 at a distance suitable for performing electrolysis. The electrolyzer cell 100 may also comprise vertical containing surfaces 122 and at least one gate 124 that, together with the horizontal cathode 120, form and provide an electrolyzer compartment 126 into which a mixture of active material and electrolyte—in the form of a slurry, for example—may be introduced, held, and processed. The vertical containing surfaces 122 and the gate 124—or at least the internal surfaces thereof relative to contents of the electrolyzer compartment 126—may be electrically non-conductive.

As shown, the anode 110 may be configured as a horizontal anode, although other forms of anode may also be utilized such as, for example, a series of anode rods, strips, grids, or other structures that could physically engage the upper surface of an electrolytic slurry emplaced onto the cathode. Regardless, the anode 110 may be suspended above the cathode 120 in the upper portion of the electrolyzer compartment 126 in such a manner that the anode would physically engage the upper surface of the mixture of active material and electrolyte being held by the electrolyzer compartment while the cathode would naturally engage the bottom surface of the active material mixture being held in the electrolyzer compartment. For those implementations featuring a horizontal anode, the anode 110 may also comprise small openings or vents 114 (i.e., "breathing holes") across its surface to allow gaseous oxygen (O2) resulting from electrolysis to harmlessly escape (instead of building up under said anode). The anode 110 may also comprise an opening 112 through which the electrolytic slurry may be emplaced into the electrolyzer compartment and onto the horizontal cathode 120 in sufficient quantity for an upper surface of said electrolytic slurry to simultaneously physically engage the suspended anode 110 and thereby complete the circuit for a current running between the cathode 120 and anode 110 for purposes of electrolysis.

The electrolyzer cell 100 may further comprise a removing mechanism 160. For various implementations, this removing mechanism 160 may comprise a vertically-oriented surface extending across the width of the electrolyzer compartment 126 and originating on the side opposite the gate 124, said surface being capable of physically contacting and gently scraping the entire cathode 120 surface and adjoining sides of the electrolyzer compartment 126 and operating below the anode 110 surface. The removing mechanism—or at least the portions thereof exposed to the contents of the electrolyzer compartment 126—may be electrically non-conductive.

FIG. 3A is an illustration providing a cut-away side view of the electrolyzer cell 100 of FIG. 2A and FIG. 2B, representative of the various implementations disclosed herein, in an initial ready-to-use configuration for conducting electrolysis. As illustrated in FIG. 3A, the electrolyzer compartment 126 is empty but ready to be filled, with the removal mechanism 160 in a set position and with the gate 124 closed. In this configuration, an electrolytic slurry may then be emplaced into the electrolyzer compartment 126 and onto the horizontal cathode 120 via a slurry line 144 extending through the opening 112 in the anode 110. Also shown in FIG. 3A is a conveyor belt 170 comprising containing sides 172 and disposed beneath the gate 124 as a conveying mechanism for use during removal of the contents of the electrolyzer compartment 126 after electrolysis is complete.

FIG. 3B is an illustration providing a cut-away side view of the electrolyzer cell 100 of FIG. 2A and FIG. 2B (as well as FIG. 3A), representative of the various implementations disclosed herein, after being filled with electrolytic materials 150 for electrolysis. As illustrated in FIG. 3B, the electrolytic materials 150 comprise a mixture of active materials 130 and electrolyte 140 as well as supplemental chemicals interspersed therein. The bottom surface of the electrolytic materials 150 physically engages (i.e., is in physical contact with) the horizontal cathode 120 while the upper surface of the electrolytic materials (specifically, the electrolyte component thereof) physically engages the anode 110. (For various implementations, sufficient electrolyte may be included in the electrolytic materials to form the upper surface of the electrolytic materials in order to prevent solid material contact from developing between the cathode and anode which might create an electrical short and prevent the cathode plate from reducing lead ions from the compounds.) An electric current can then be applied to the electrolytic materials 150 via the anode 110 and cathode 120, with the electrical circuit being completed by the mobile ions in electrolyte 140, and with electrolysis taking place in said electrolytic materials 150 accordingly.

FIG. 3C is an illustration providing a cut-away side view of the electrolyzer cell 100 of FIG. 2A and FIG. 2B (as well as FIG. 3A and FIG. 3B), representative of the various implementations disclosed herein, after electrolysis has been performed and liquid components 142 have been drained from the electrolyzing compartment 126 by opening the gate 124 into a first position that provides sufficient space through which said liquid components can pass from the electrolyzer compartment 126 onto the conveyor belt 170 for recovery of said liquid components. Meanwhile the desired end product 132 of the electrolysis remains on the horizontal cathode 120 awaiting removal from the electrolyzer compartment 126.

FIG. 3D is an illustration providing a cut-away side view of the electrolyzer cell 100 of FIG. 2A and FIG. 2B (as well as FIG. 3A, FIG. 3B, and FIG. 3C), representative of the various implementations disclosed herein, after the end product 132 resulting from the electrolysis has been removed from the horizontal cathode 120 surface and from the electrolyzing compartment. As shown in FIG. 3D, the gate 124 has moved to a second fully-open position and the removal mechanism 160 has traversed the interior of the electrolyzer cell 100 and removed the end product 132 from the electrolyzer cell 100 and onto the conveyor belt 170. With the removal mechanism 160 in this deployed position and the gate 124 fully open as shown, the empty interior of the electrolyzer cell 128 is no longer an electrolyzing compartment 126 but will again become an electrolyzing compartment 126 after the removal mechanism 160 is returned to its original position and the gate 124 is closed (as shown in FIG. 3A for example). For convenience, FIG. 3A, FIG. 3B, FIG. 3C, and FIG. 3D may be collectively referred to herein as FIG. 3.

Figure 4A:
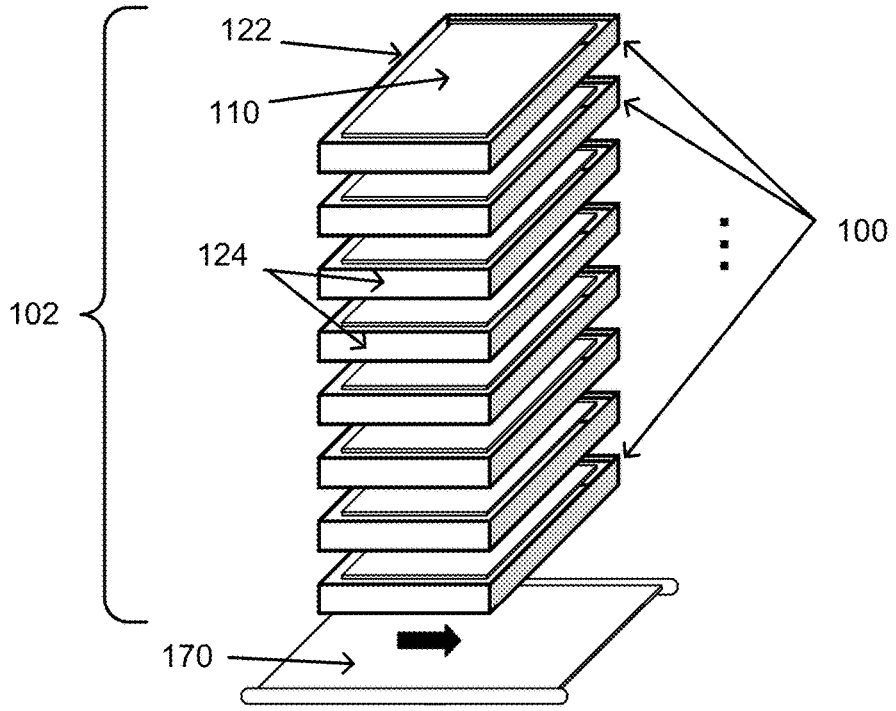
FIG. 4A is an illustration providing a perspective view of a vertical stack of electrolyzer cells representative of various implementations disclosed herein.

FIG. 4A is an illustration providing a perspective view of a vertical stack 102 of electrolyzer cells 100 representative of various implementations disclosed herein. As shown in FIG. 4A, multiple electrolyzer cells 100 may be vertically orientated over a single conveyor belt 170 (further distinguished in the drawing by the block motion arrow) in order to increase overall capacity, minimize floorspace (or footprint), and increase conveyor belt 170 utilization (and minimize conveyor belt 170 buildout).

Although the implementation represented by FIG. 4A shows each electrolyzer 100 having their own individual gates 124, for certain alternative implementations all of these gates 124 in the stack 102 may instead be integrated into a single, multi-electrolyzer gate that engages the end of each individual electrolyzer 100 but which may be opened or closed as a single unit above the conveyor belt 170. For several such alternative implementations the single multi-electrolyzer gate may be configured so as to not make contact with the individual anodes 110, although for some such alternative implementations the single multi-electrolyzer gate and the individual anodes may be configured to make contact but wherein the multi-electrolyzer gate, being made of a non-conductive material, would not conduct electricity between the horizontal cathodes 120 and the anodes 110. Moreover, many different gate configurations are readily evident and nothing herein should be interpreted as precluding any specific gate configurations.

Figure 4B:
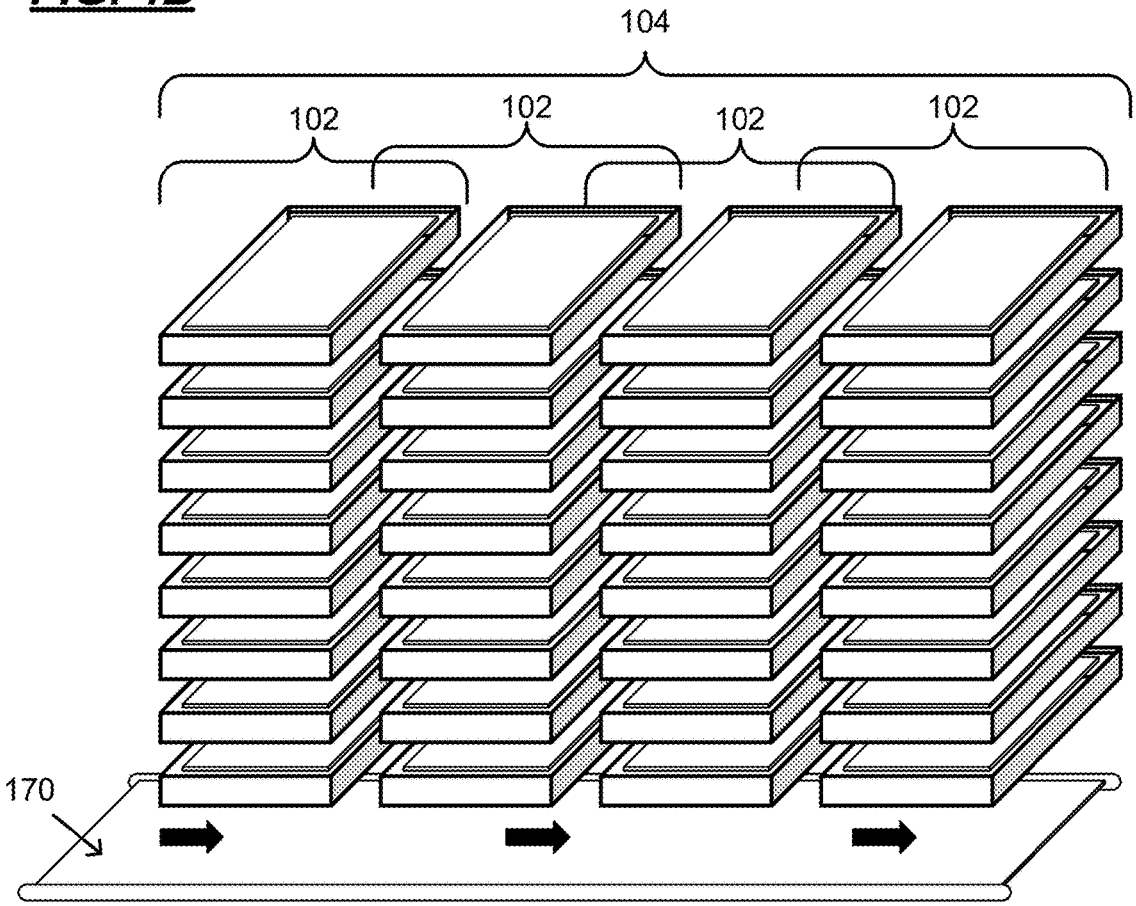
FIG. 4B is an illustration providing a perspective view of a lateral line comprising multiple stacks of electrolyzer cells representative of various implementations disclosed herein.

FIG. 4B is an illustration providing a perspective view of a lateral line 104 comprising multiple vertical stacks 102 of electrolyzer cells 100 representative of various implementations disclosed herein. As shown in FIG. 4B, multiple stacks may be linearly oriented over a single conveyor belt 170 to further increase overall capacity while again increasing conveyor belt 170 utilization (and minimize conveyor belt 170 buildout) versus the need for individual conveyor belts for each stack 102. Furthermore, for certain implementations, multiple stacks 102 may be oriented on both sides of the conveyor belt 170 to form a duplex line (not shown).

Although the implementation represented by FIG. 4B again shows each electrolyzer 100 having their own individual gates 124, for certain alternative implementations all of these gates 124 in the lateral line 104 may instead be integrated into a single, multi-electrolyzer gate "wall" that engages the end of each individual electrolyzer 100 in each stack 102 in the lateral line 104 but which may be opened or closed as a single unit above the conveyor belt 170. For several such alternative implementations the single multi-electrolyzer gate wall may be configured so as to not make contact with the individual anodes 110, although for some such alternative implementations the single multi-electrolyzer gate wall and the individual anodes may be configured to make contact but wherein the multi-electrolyzer gate wall, being made of a non-conductive material, would not conduct electricity between the horizontal cathodes 120 and the anodes 110. Moreover, many different gate wall configurations are readily evident and nothing herein should be interpreted as precluding any specific gate wall configurations.

Figure 4C:
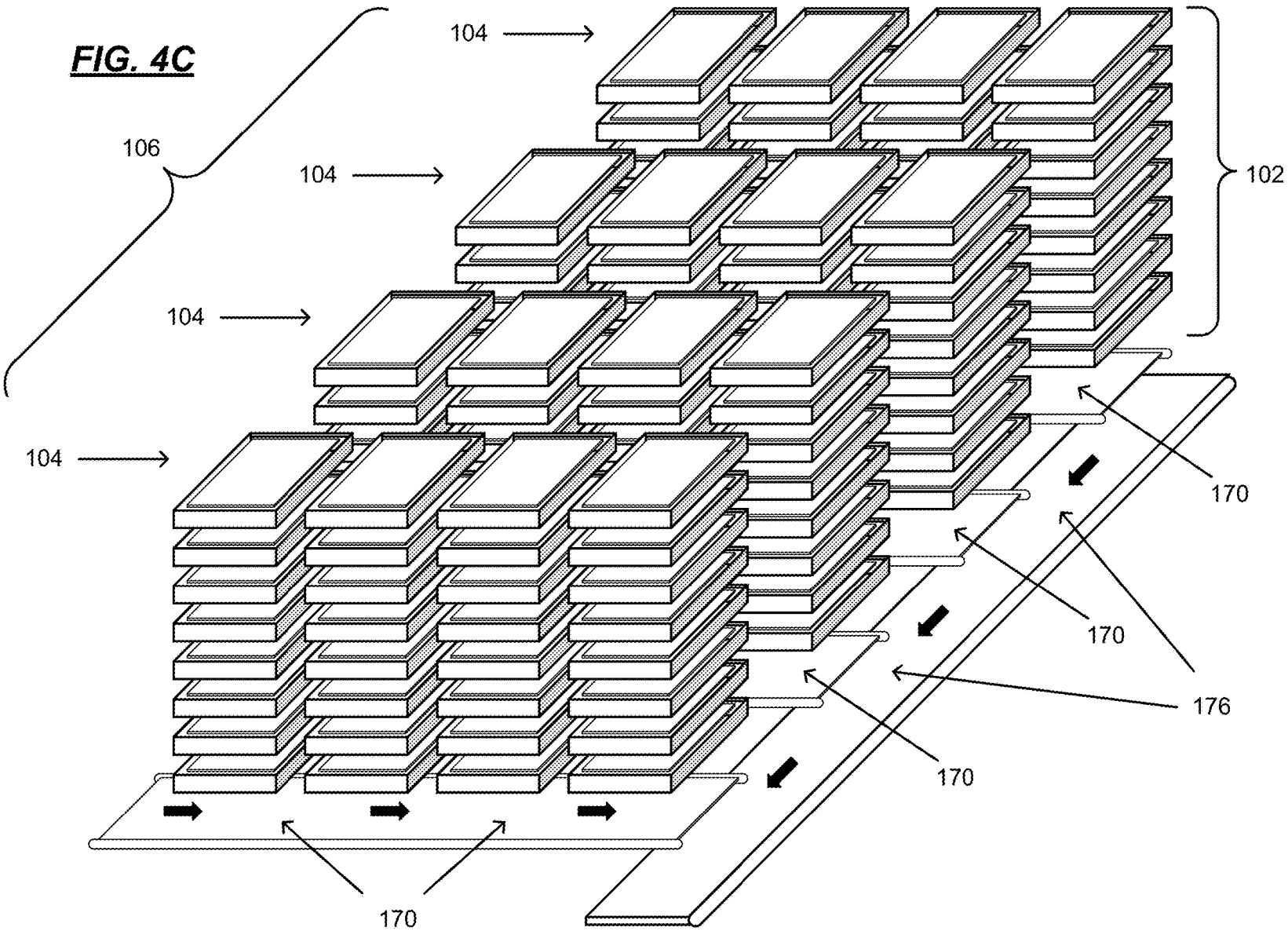
FIG. 4C is an illustration providing a perspective view of a parallel array of multiple lateral lines each comprising multiple stacks of electrolyzer cells representative of various implementations disclosed herein.

FIG. 4C is an illustration providing a perspective view of a parallel array 106 of multiple lateral lines 104 each comprising multiple stacks 102 of electrolyzer cells 100 representative of various implementations disclosed herein. As shown in FIG. 4C, a plurality of lateral lines 104 and their corresponding conveyor belts may be arranged to form a three-dimensional array 106 of electrolyzer cells that feed into a consolidated cross-conveyor belt 176. Furthermore, for certain implementations, the conveyor belts 170 from multiple lines 104 may be oriented on both sides of the cross-conveyor belt 176 to form a duplex array (not shown). Moreover, the specific height, length, and width of such a parallel array 106 can be configured to optimally fit in almost any three-dimensional space although alternative or additional conveyor belt configurations may be needed. For convenience, FIG. 4A, FIG. 4B, and FIG. 4C may be collectively referred to herein as FIG. 4.

Although the electrolyzer cells 100 of FIGS. 2-4 show the anode 110 not contacting the vertical containing surfaces 122 and/or the gate 124, alternative implementations may utilize a larger anode that does make contact with the vertical containing surfaces 122 and/or the gate 124 when the vertical containing surfaces 122 and/or the gate 124 are made of a non-conductive material and thus would not conduct electricity between the horizontal cathodes 120 and the anodes 110.

Bipolar Electrolyzer Cell with Horizontal Cathode

With regard to FIG. 4A (as well as FIG. 4B and FIG. 4C) and, specifically, the featured vertical stack 102 comprising multiple electrolyzer cells 100 and depositing onto a single conveyor belt 170 as one approach and solution for increasing capacity while minimizing floorspace (or footprint) and increasing conveyor belt 170 utilization (while minimizing conveyor belt 170 buildout)—an alternative solution representative of the various implementations disclosed herein utilizes one or more "bipolar electrolyzers" each comprising a "bipolar cathode" where the exterior underside of each such bipolar cathodes operates as an anode (or "acting anode") for another electrolyzer located directly beneath the subject electrolyzer as a modified version of the vertical stack 102.

FIG. 5A is an illustration providing a cut-away side view of a bipolar electrolyzer cell 200 comprising a horizontally-oriented bipolar cathode 220, representative of the various implementations disclosed herein, in an unfilled ready-to-use configuration for conducting electrolysis (akin to FIG. 3A). FIG. 5B is an illustration providing a cut-away side view of the bipolar electrolyzer cell comprising a bipolar cathode of FIG. 5A, representative of the various implementations disclosed herein, after being filled with electrolytic materials for electrolysis (akin to FIG. 3B).

For these various implementations, the bipolar electrolyzer cell 200 may comprise sloped containing surfaces 222 and at least one sloped gate 224 that, together with the horizontal bipolar cathode 220, form and provide a sloped electrolyzer compartment 226 into which a mixture of active material and electrolyte—in the form of a slurry, for example—may be introduced, held, and processed. Notably, despite being sloped, the sloped gate 224 is configured to engage the bipolar cathode 220 and the adjoining sloped containing surfaces 222 in a manner sufficient to contain the slurry without undue leaking in a manner very much akin to the operation of vertical gate 124 utilized in the electrolyzer 100 shown in FIG. 3A and FIG. 3B. The sloped containing surfaces 222 and the sloped gate 224—either entirely or at least the internal surfaces thereof relative to contents of the electrolyzer compartment 226—may be electrically non-conductive. The utilization of sloped sides as shown in FIG. 5A enable an acting anode 110' (such as anode 110 or the exterior underside of another bipolar cathode, and herein illustrated with dotted lines to represent an "acting anode" or anode functionality in any suitable form for performing electrolysis in conjunction with the bipolar electrolyzer 200) be of the same size and shape as the horizontal bipolar cathode 220 and still be suspended within the top portion of the electrolyzer compartment 226 and oriented to physically engage the contents of the electrolyzer compartment 226 without physically engaging the sloped components (although alternative approaches, including different physical configurations for the electrolyzer that are also capable of achieving such an orientation, may also be utilized in alternative implementations). As illustrated in FIG. 5B, the acting anode 110' is suspended above the bipolar cathode 220 at a distance from the bipolar cathode 220 but engaging the upper surface of the contents within the sloped electrolyzer compartment 226 as necessary and suitable for performing electrolysis.

Figure 5C:
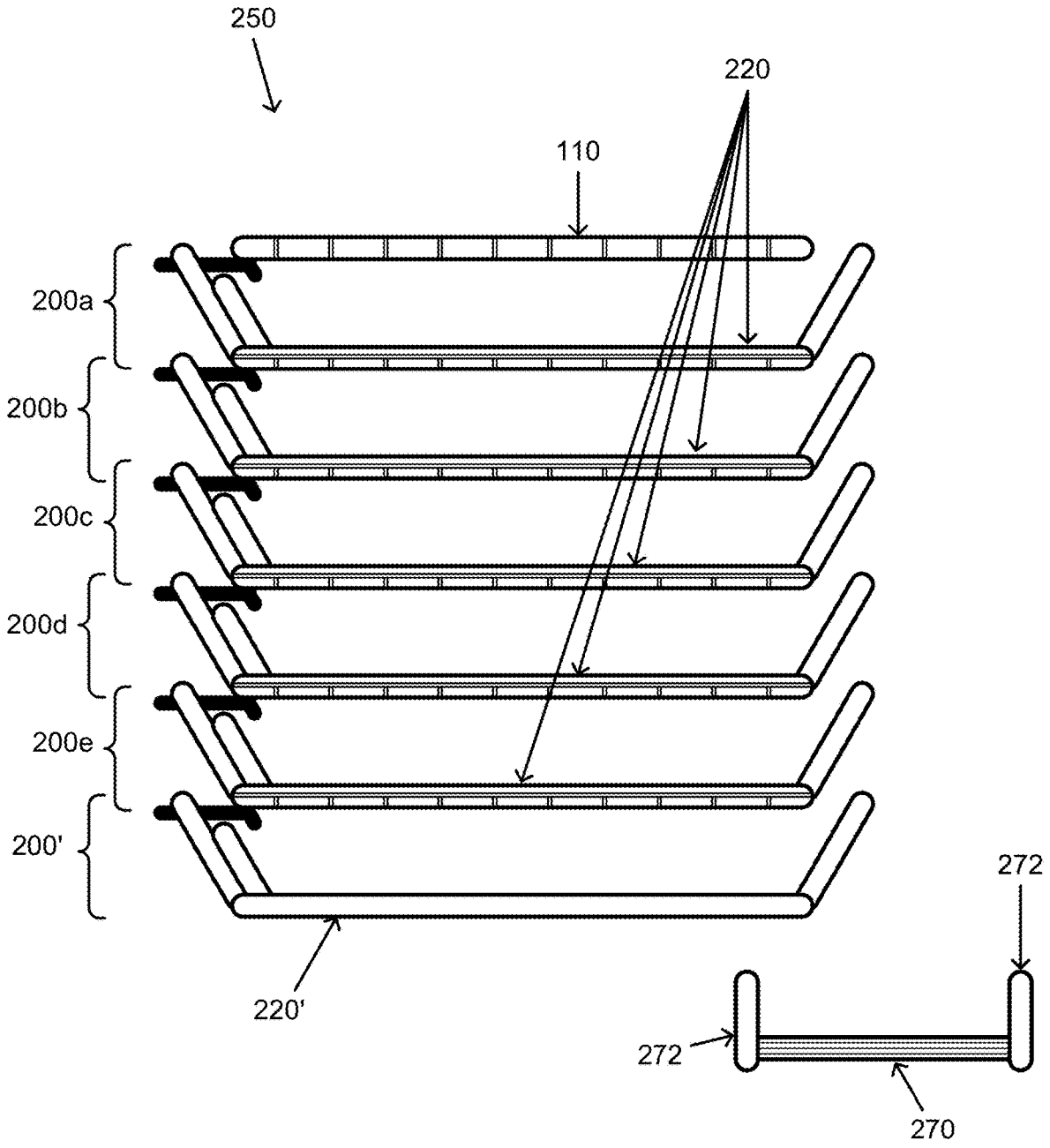
FIG. 5C is an illustration providing a cut-away side view of a plurality of the unfilled ready-to-use bipolar electrolyzer cells of FIG. 5A oriented vertically, one above the other, in a manner representative of the various implementations disclosed herein.
Figure 5D:
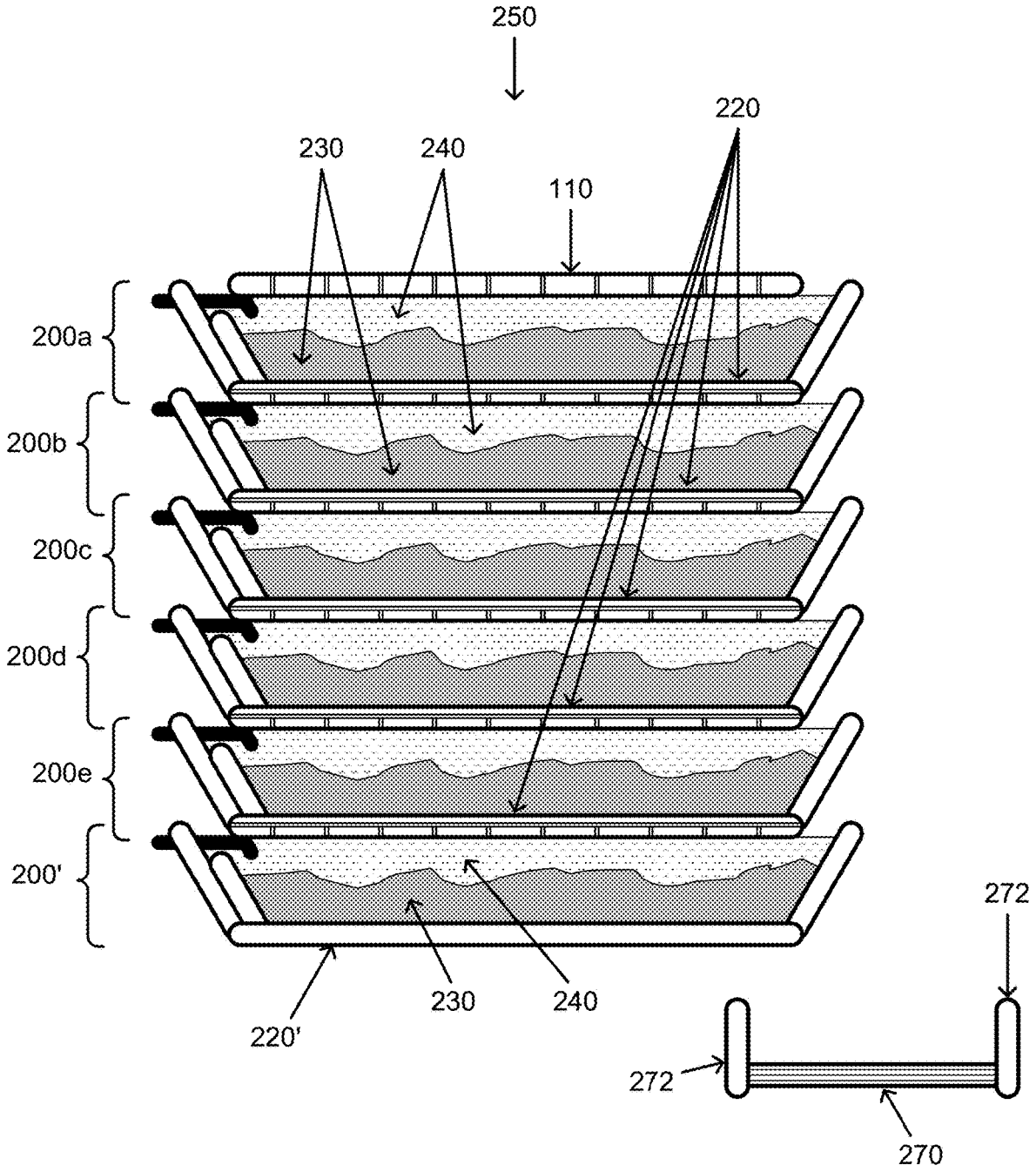
FIG. 5D is an illustration providing a cut-away side view of the plurality of vertically-oriented bipolar electrolyzer cells of FIG. 5C, representative of the various implementations disclosed herein, shown here filled with electrolytic materials for electrolysis (akin to FIG. 5B)

Additionally, at least one sloped containing surface 222 may comprise an opening 212 through which the electrolytic slurry may be emplaced into the electrolyzer compartment 226 and onto the horizontal cathode 220 in sufficient quantity for an upper surface of said electrolytic slurry to simultaneously physically engage an acting anode 110'—either a suspended anode 110, the exterior underside of another bipolar cathode corresponding to another bipolar electrolyzer positioned directly above and partially within the upper portion of the electrolyzer compartment 226 (as shown in FIGS. 5C and 5D described more fully later herein), or any other acting anode—and thereby complete the circuit for a current running between the bipolar cathode 220 and such acting anode for purposes of conducting electrolysis on active materials located in the electrolyzer compartment 226.

The bipolar electrolyzer cell 200 may further comprise a removing mechanism 260 which may also be sloped. For various implementations, this removing mechanism 260 may comprise a pushing surface extending across the width of the electrolyzer compartment 226 and originating on the side opposite the gate 224, said surface being capable of physically contacting and gently scraping the entire cathode 220 surface and adjoining sides of the electrolyzer compartment 226 while operating below the surface of the acting anode 110'. The removing mechanism—or at least the portions thereof exposed to the contents of the electrolyzer compartment 226—may be electrically non-conductive. The removing mechanism 260 may also operate in conjunction with a conveyor belt 270 comprising containing sides 272 and disposed beneath the gate 224 as a conveying mechanism for use during removal of the contents of the electrolyzer compartment 226 after electrolysis is complete and for conveying the contents from the electrolyzer to the transformer for further processing.

For certain implementations, the horizontal bipolar cathode 220 may further comprise small openings or vents 214 (i.e., "breathing holes") across the surface of its exterior underside that are connected to air tunnels 216 within the bipolar cathode 220 that end in lateral exits 218 such that, when the bipolar cathode 220 is operating as an acting anode for another bipolar electrolyzer located directly beneath it, the vents 214, air tunnels 216, and lateral exits 218 (collectively, a "venting substructure") allow gaseous oxygen (O2) from below to harmlessly escape (instead of building up underneath said bipolar cathode 220) yet without passing the gaseous oxygen (O2) into the electrolyzer compartment 226. Select alternative implementations, however, may instead use vents (akin to vents 114' shown in FIG. 5B and akin to those of the anode 110 described earlier herein) to pass oxygen through its own electrolyzer compartment 226, or may instead use surface channels, a curved surface, or other features to direct oxygen away from the exterior underside of the bipolar cathode 220.

Although the implementations represented by FIG. 5A and FIG. 5B comprise a sloped gate 224, for certain alternative implementations this gate may instead be vertical, akin to the gate 124 shown in FIG. 3A, where the upper edge of the gate is low enough to not interfere with the placement of the active cathode 110' positioned above it, including when the active cathode 110' is another bipolar cathode of another electrolyzer placed above the current electrolyzer 200. For several such alternative implementations, the upper edge of such a vertical gate may make contact with an active cathode positioned above it but, being made of a non-conductive material, said vertical gate would not conduct electricity between the bipolar cathode 220 and any such active anode 110'. Moreover, many different gate configurations are readily evident and nothing herein should be interpreted as precluding any specific gate configurations.

FIG. 5C is an illustration providing a cut-away side view of a plurality of the unfilled ready-to-use bipolar electrolyzer cells of FIG. 5A oriented vertically, one above the other, in a manner representative of the various implementations disclosed herein. FIG. 5D is an illustration providing a cut-away side view of the plurality of vertically-oriented bipolar electrolyzer cells of FIG. 5C, representative of the various implementations disclosed herein, filled with electrolytic materials for electrolysis (akin to FIG. 5B).

As shown, the bipolar cathodes 220 of each bipolar electrolyzer 200*a*, 200*b*, 200*c*, 200*d*, and 200*e* are oriented to engage the upper surface of the contents of the electrolyzer beneath it in order to function as the active anode therefore. In addition to the exemplary five bipolar electrolyzers 200*a*, 200*b*, 200*c*, 200*d*, and 200*e* included in the illustrated vertically-oriented bipolar electrolyzer assembly ("assembly") 250—the number of which may increase or decrease as desired in alternative implementations—the assembly further comprises a horizontal anode 110 (akin to horizontal anode 110 of FIG. 3) for operation with the topmost bipolar electrolyzer 200*a*. Furthermore, as illustrated in FIG. 5C and FIG. 5D, the assembly 250 also comprises a bottommost electrolyzer 200' which may be a special electrolyzer akin to the bipolar electrolyzer 200 of FIG. 5A and FIG. 5B but having a "uni-polar" horizontal cathode 220' (similar to horizontal cathode 120 of FIG. 3A and FIG. 3B) in lieu of a bipolar cathode 220 because no active anode is necessary for an electrolyzer in this bottommost position. Nevertheless, for some implementations another bipolar electrolyzer comprising a bipolar cathode may still be utilized in the bottommost position albeit with its bipolar cathode simply not functioning as an active anode. For convenience, FIG. 5A, FIG. 5B, FIG. 5C, and FIG. 5D may be collectively referred to herein as FIG. 5.

Notably, with the various electrolyzers vertically oriented as shown in FIG. 5C and FIG. 5D, only the topmost active anode and the bottommost cathode require direct connection to the external power supply providing the electrical current needed for performing electrolysis as the current effectively passes in series between each successive electrolyzer and its electrolytic contents.

Although the electrolyzer cells 200 of FIG. 5 show the anode 110 not contacting the sloped containing surfaces 222 and/or the sloped gates 224, alternative implementations may utilize vertical containing surfaces (akin to 112) and/or vertical gates (akin to 124) where the upper edges of such do make contact with an active cathode 110' positioned above them but, being made of a non-conductive material, said vertical containing surfaces and vertical gate would not conduct electricity between the bipolar cathode 220 and any such active anode 110' including when the active anode 110' is actually another bipolar cathode from another electrolyzer cell positioned above the present electrolyzer cell 200.

Furthermore, although the implementation represented by FIG. 5 show each electrolyzer 200 having their own individual gates 224, for certain alternative implementations all of these gates 224 in the stack 250 may instead be integrated into a single, multi-electrolyzer gate (or gate "wall"), vertical or otherwise, that engages the end of each individual electrolyzer 100 in each stack 102 (or array of stacks akin to the lateral line 104 of FIG. 4B) but which may be opened or closed as a single unit. For several such alternative implementations the single multi-electrolyzer gate may be configured so as to not make contact with the individual bipolar cathodes 220, although for some such alternative implementations the single multi-electrolyzer gate wall and the bipolar cathodes 220 may be configured to make contact but wherein the multi-electrolyzer gate, being made of a non-conductive material, would not conduct electricity between the successive bipolar cathodes 220. Moreover, many different gate (and gate wall) configurations are readily evident, and thus nothing herein should be interpreted as precluding any specific gate (or gate wall) configurations.

Accordingly, various implementations disclosed herein are directed to an electrolyzer assembly comprising: a first bipolar electrolyzer comprising a first horizontal bipolar cathode upon which an electrolytic slurry may be emplaced for electrolysis; and a second bipolar electrolyzer comprising a second horizontal bipolar cathode, said second bipolar electrolyzer oriented vertically above the first bipolar electrolyzer such that a bottom surface of the second horizontal bipolar cathode is capable of electrically engaging an upper surface of the electrolytic slurry, said second horizontal cathode operating as an active anode for electrolysis of the electrolytic slurry. Several such implementations may further comprise one or more of the following features: wherein the first bipolar electrolyzer further comprises sloped containing surfaces for containing the electrolytic slurry upon the first horizontal bipolar cathode and permitting the second horizontal bipolar cathode to electrically engage the upper surface of the electrolytic slurry; wherein the first bipolar electrolyzer further comprises a sloped gate in the sloped containing surfaces through which an end product resulting from electrolysis can be removed from the first horizontal bi-polar cathode; wherein the first bipolar electrolyzer further comprises a removing mechanism for removing, from the horizontal cathode, an end product resulting from electrolysis; a third horizontal bipolar electrolyzer comprising a third horizontal bipolar cathode, said third bipolar electrolyzer oriented vertically above the second bipolar electrolyzer, said third horizontal cathode capable of operating as an active anode for electrolysis of a second electrolytic slurry emplaced upon the second bipolar cathode; an anode suspended above the second horizontal bipolar cathode for physically engaging a second electrolytic slurry contained by the second bipolar electrolyzer; a special electrolyzer oriented vertically below the first electrolyzer, said special electrolyzer comprising a uni-polar horizontal cathode oriented to operate with the first horizontal bipolar cathode for performing electrolysis; wherein the second bipolar electrolyzer further comprises a venting substructure through which gaseous compounds resulting from electrolysis as the active anode for the first bipolar electrolyzer may pass; a direct current electrical supply and a power controller for controlling a current during electrolysis at one or more levels at one or more time periods during electrolysis; wherein the second horizontal bipolar cathode is suspended substantially parallel to the first horizontal bipolar cathode and between 40 mm to 140 mm above the first horizontal bipolar cathode during electrolysis; further comprising a slurry line for emplacing the electrolytic slurry onto the first horizontal bipolar cathode; and/or a slurry line for emplacing the electrolytic slurry onto the first horizontal bipolar cathode.

Several alternative implementations disclosed herein are also directed to apparatus for performing electrolysis comprising: a first horizontal bipolar cathode having a surface onto which an electrolytic slurry may be emplaced for electrolysis; and a second horizontal bipolar cathode suspended above the first horizontal bipolar cathode and comprising a horizontal surface for physically engaging an upper surface of the electrolytic slurry for electrolysis in which the second horizontal bipolar cathode functions as an active anode with regard to the first horizontal bipolar cathode during electrolysis. Certain such implementations may further comprise one or more of the following features: sloped containing surfaces for containing the electrolytic slurry onto the first horizontal bipolar cathode; at least one gate in the sloped containing surfaces through which an end product resulting from electrolysis can be removed from the first horizontal bipolar cathode; a removing mechanism for removing, from the first horizontal bipolar cathode, an end product resulting from electrolysis; wherein the second horizontal bipolar cathode comprises a venting substructure through which gaseous compounds resulting from electrolysis may pass; and/or wherein the second horizontal bipolar cathode is between 40 mm and 140 mm above the first horizontal bipolar cathode during electrolysis.

Select implementations disclosed herein may also be directed to an alternative system for performing electrolysis on an electrolytic slurry comprising: a first horizontal bipolar cathode having a surface onto which the electrolytic slurry may be emplaced for electrolysis; and a second horizontal bipolar cathode electrically engaging the electrolytic slurry for electrolysis, the second horizontal bipolar cathode suspended above the first horizontal bipolar cathode and comprising a horizontal surface for physically engaging an upper surface of the electrolytic slurry for electrolysis, wherein the second horizontal bipolar cathode functions as an active anode with regard to the first horizontal bipolar cathode during electrolysis. For some such systems, the horizontal anode surface may comprise a venting substructure through which gaseous compounds resulting from electrolysis may pass.

With regard to all of the various implementations disclosed herein, alternative implementations are also anticipated wherein the cathode element are anodes and the anode elements are cathodes, and other such equivalent substitutions or reverse-processing. Moreover, each step of the processes performed by the various implementations herein disclosed may be performed and controlled by a processing unit or other computing environment to include (but in no way limited to) timing of each step of the operation, coordination between different electrolyzer cells, slurry lines, conveyor belts, etc., and variations in time and charge utilized throughout the electrolysis processes, as well as receiving and reacting to feedback from electrical resistance and other detectable occurrences from the electrolysis while in progress.

Electrolyte and Supplemental Chemicals

As disclosed earlier herein, sodium hydroxide (NaOH)—as well as potassium hydroxide (KOH) and the like—may be used as the electrolyte for subsequent electrolytic processing (e.g., electrolysis) of the lead paste, in which case the resultant lead slurry would be a mixture of the desulfurized lead paste plus the electrolyte (and not a solution thereof in the chemical sense). This approach is a departure from typical electrolytic processing of lead paste dissolved and suspended in an electrolyte solution, noting that typical electrolytic processing has no need of the supplemental chemicals whereas electrolytic processing of a mixture benefits from the supplemental chemicals.

FIG. 6A is an annotated chemical illustration of the respective molecular structures for lead monoxide (PbO) 502, lead dioxide (PbO2) 504, and lead hydroxide (Pb(OH)2) 506 (collectively the "oxidized lead components" or "lead oxides"). FIG. 6B is an annotated chemical illustration of the respective molecular structures for lead sulfate (PbSO4) which, for clarity, is shown with bonding charges 508*a* and without 508*b* (that is, with the lead (Pb) atom collocated with the two oxygen atoms having a single bond with the sulfur atom). As previously mentioned, the lead paste derived from LABs during recycling typically comprising portions of pure lead as well as lead monoxide, lead dioxide, and lead sulfate.

Lead monoxide (PbO)—also commonly referred to as lead(II) oxide—has a +2 oxidation state. PbO is formed during discharge of the LAB as a proton-electron mechanism of PbO2 reduction (noting that the positive plate of an LAB is comprised of PbO2 whereas the negative plate of the LAB is comprised of pure lead Pb).

Lead dioxide (PbO2)—also commonly referred to as lead(IV) oxide—has a +4 oxidation state. The positive plate of an LAB is comprised of PbO2 whereas, in contrast, the negative plate of the LAB is comprised of pure lead Pb.

Lead hydroxide (Pb(OH)2)—also commonly referred to as lead(IV) oxide or less precisely as "lead hydrate" (this latter term also used to refer to Pb(H20)2)—has a +2 oxidation state. Pb(OH)2 results from interactions between the PbO2 plate in an LAB and the aqueous sulfuric acid (H2SO4) solution of the LAB (and also resulting in PbSO4). As described earlier herein, lead sulfate (PbSO4) is converted into lead hydroxide (Pb(OH)2) during desulfurization that occurs before electrolytic processing.

In order for an electrolytic process to successfully recover elemental lead (Pb) from the lead oxides present in the lead slurry prepared for solid-state electrolysis, one or more supplemental chemicals may be added to the lead slurry mixture (comprising the electrolyte and oxidized lead components) prior to electrolytic processing. During electrolysis these supplemental chemicals would effectively enable the oxygen (O) and/or hydroxide (OH) molecules in the lead oxides to disassociate from the lead (Pb) and combine to form gaseous O2 (which may then dissipate out of the mixture and into the surrounding air) and/or aqueous water (H2O) (which may then remain in the mixture and be pressed out or boiled away in subsequent processing of the resultant elemental lead (Pb)).

Figure 7:
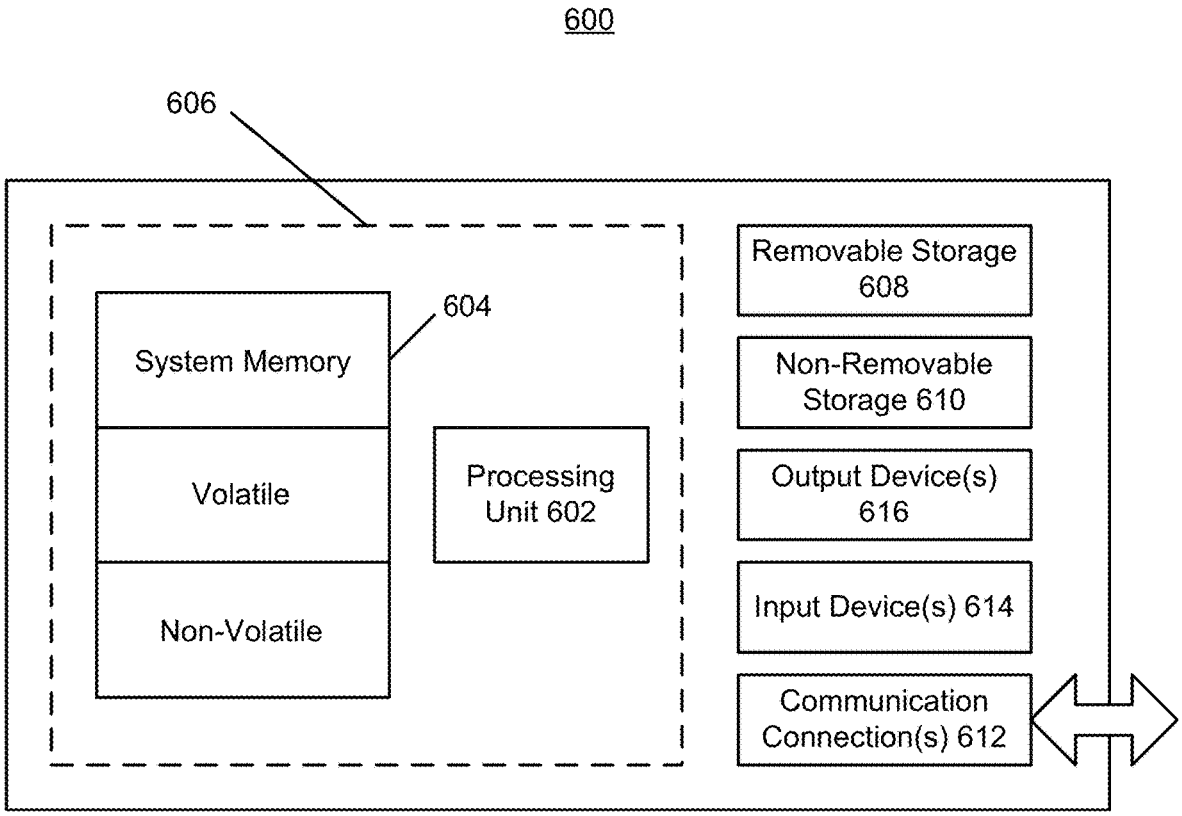
FIG. 7 is a block diagram of an example computing environment that may be used in conjunction with any of the various implementations and aspects herein disclosed.

FIG. 7 is a block diagram of an example computing environment that may be used in conjunction with example implementations and aspects such as those disclosed and described with regard to the other figures presented herein and herewith. The computing system environment is only one example of a suitable computing environment and is not intended to suggest any limitation as to the scope of use or functionality.

Numerous other general purpose or special purpose computing system environments or configurations may be used. Examples of well-known computing systems, environments, and/or configurations that may be suitable for use include, but are not limited to, personal computers (PCs), server computers, handheld or laptop devices, multiprocessor systems, microprocessor-based systems, network PCs, minicomputers, mainframe computers, embedded systems, distributed computing environments that include any of the above systems or devices, and the like.

Computer-executable instructions, such as program modules, being executed by a computer may be used. Generally, program modules include routines, programs, objects, components, data structures, and so forth that perform particular tasks or implement particular abstract data types. Distributed computing environments may be used where tasks are performed by remote processing devices that are linked through a communications network or other data transmission medium. In a distributed computing environment, program modules and other data may be located in both local and remote computer storage media including memory storage devices.

The various illustrative logics, logical blocks, modules, and circuits described in connection with the aspects disclosed herein may be implemented or performed with a general purpose processor, a digital signal processor (DSP), an application specific integrated circuit (ASIC), a field programmable gate array (FPGA), an analog-to-digital converter (ADC), or other programmable logic device, discrete gate or transistor logic, discrete hardware components, discrete data acquisition components, or any combination thereof designed to perform the functions described herein. A general-purpose processor may be a microprocessor, but, in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration. Additionally, at least one processor may comprise one or more modules operable to perform one or more of the steps and/or actions described above.

With reference to FIG. 7, an exemplary system for implementing aspects described herein includes a computing device, such as computing device 600. In a basic configuration, computing device 600 typically includes at least one processing unit 602 and memory 604. Depending on the exact configuration and type of computing device, memory 604 may be volatile (such as random access memory (RAM)), non-volatile (such as read-only memory (ROM), flash memory, etc.), or some combination of the two. This basic configuration is illustrated in FIG. 7 by dashed line 606 and may be referred to collectively as the "compute" component.

Computing device 600 may have additional features/functionality. For example, computing device 600 may include additional storage (removable and/or non-removable) including, but not limited to, magnetic or optical disks or tape. Such additional storage is illustrated in FIG. 7 by removable storage 608 and non-removable storage 610. Computing device 600 typically includes a variety of computer readable media. Computer readable media can be any available media that can be accessed by device 600 and may include both volatile and non-volatile media, as well as both removable and non-removable media.

Computer storage media include volatile and non-volatile media, as well as removable and non-removable media, implemented in any method or technology for storage of information such as computer readable instructions, data structures, program modules or other data. Memory 604, removable storage 608, and non-removable storage 610 are all examples of computer storage media. Computer storage media include, but are not limited to, RAM, ROM, electrically erasable program read-only memory (EEPROM), flash memory or other memory technology, CD-ROM, digital versatile disks (DVD), or other optical storage, magnetic cassettes, magnetic tape, magnetic disk storage or other magnetic storage devices, or any other medium which can be used to store the information and which can be accessed by computing device 600. Any such computer storage media may be part of computing device 600.

Computing device 600 may contain communication connection(s) 612 that allow the device to communicate with other devices. Computing device 600 may also have input device(s) 614 such as a keyboard, mouse, pen, voice input device, touch input device, and so forth. Output device(s) 616 such as a display, speakers, printer, and so forth may also be included. All these devices are well-known in the art and need not be discussed at length herein. Computing device 600 may be one of a plurality of computing devices 600 inter-connected by a network. As may be appreciated, the network may be any appropriate network, each computing device 600 may be connected thereto by way of communication connection(s) 612 in any appropriate manner, and each computing device 600 may communicate with one or more of the other computing devices 600 in the network in any appropriate manner. For example, the network may be a wired or wireless network within an organization or home or the like, and may include a direct or indirect coupling to an external network such as the Internet or the like. Moreover, PCI, PCIe, and other bus protocols might be utilized for embedding the various implementations described herein into other computing systems.

Interpretation of Disclosures Herein

It should be understood that the various techniques described herein may be implemented in connection with hardware or software or, where appropriate, with a combination of both. Thus, the processes and apparatus of the presently disclosed subject matter, or certain aspects or portions thereof, may take the form of program code (i.e., instructions) embodied in tangible media, such as floppy diskettes, CD-ROMs, hard drives, or any other machine-readable storage medium where, when the program code is loaded into and executed by a machine, such as a computer, the machine becomes an apparatus for practicing the presently disclosed subject matter.

In the case of program code execution on programmable computers, the computing device generally includes a processor, a storage medium readable by the processor (including volatile and non-volatile memory and/or storage elements), at least one input device, and at least one output device. One or more programs may implement or utilize the processes described in connection with the presently disclosed subject matter, e.g., through the use of an API, reusable controls, or the like. Such programs may be implemented in a high-level procedural or object-oriented programming language to communicate with a computer system. However, the program(s) can be implemented in assembly or machine language. In any case, the language may be a compiled or interpreted language and it may be combined with hardware implementations.

Although exemplary implementations may refer to utilizing aspects of the presently disclosed subject matter in the context of one or more stand-alone computer systems, the subject matter is not so limited, but rather may be implemented in connection with any computing environment, such as a network or distributed computing environment. Still further, aspects of the presently disclosed subject matter may be implemented in or across a plurality of processing chips or devices, and storage may similarly be affected across a plurality of devices. Such devices might include PCs, network servers, and handheld devices, for example.

Certain implementations described herein may utilize a cloud operating environment that supports delivering computing, processing, storage, data management, applications, and other functionality as an abstract service rather than as a standalone product of computer hardware, software, etc. Services may be provided by virtual servers that may be implemented as one or more processes on one or more computing devices. In some implementations, processes may migrate between servers without disrupting the cloud service. In the cloud, shared resources (e.g., computing, storage) may be provided to computers including servers, clients, and mobile devices over a network. Different networks (e.g., Ethernet, Wi-Fi, 802.x, cellular) may be used to access cloud services. Users interacting with the cloud may not need to know the particulars (e.g., location, name, server, database, etc.) of a device that is actually providing the service (e.g., computing, storage). Users may access cloud services via, for example, a web browser, a thin client, a mobile application, or in other ways. To the extent any physical components of hardware and software are herein described, equivalent functionality provided via a cloud operating environment is also anticipated and disclosed.

Additionally, a controller service may reside in the cloud and may rely on a server or service to perform processing and may rely on a data store or database to store data. While a single server, a single service, a single data store, and a single database may be utilized, multiple instances of servers, services, data stores, and databases may instead reside in the cloud and may, therefore, be used by the controller service. Likewise, various devices may access the controller service in the cloud, and such devices may include (but are not limited to) a computer, a tablet, a laptop computer, a desktop monitor, a television, a personal digital assistant, and a mobile device (e.g., cellular phone, satellite phone, etc.). It is possible that different users at different locations using different devices may access the controller service through different networks or interfaces. In one example, the controller service may be accessed by a mobile device. In another example, portions of controller service may reside on a mobile device. Regardless, controller service may perform actions including, for example, presenting content on a secondary display, presenting an application (e.g., browser) on a secondary display, presenting a cursor on a secondary display, presenting controls on a secondary display, and/or generating a control event in response to an interaction on the mobile device or other service. In specific implementations, the controller service may perform portions of methods described herein.

Anticipated Alternatives

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. Moreover, it will be apparent to one skilled in the art that other implementations may be practiced apart from the specific details disclosed above.

The drawings described above and the written description of specific structures and functions below are not presented to limit the scope of what has been invented or the scope of the appended claims. Rather, the drawings and written description are provided to teach any person skilled in the art to make and use the inventions for which patent protection is sought. Those skilled in the art will appreciate that not all features of a commercial implementation of the inventions are described or shown for the sake of clarity and understanding. Skilled artisans will further appreciate that block diagrams herein can represent conceptual views of illustrative circuitry embodying the principles of the technology, and that any flow charts, state transition diagrams, pseudocode, and the like represent various processes which may be embodied in computer readable medium and so executed by a computer or processor, whether or not such computer or processor is explicitly shown. The functions of the various elements including functional blocks may be provided through the use of dedicated electronic hardware as well as electronic circuitry capable of executing computer program instructions in association with appropriate software. Persons of skill in this art will also appreciate that the development of an actual commercial implementation incorporating aspects of the inventions will require numerous implementation-specific decisions to achieve the developer's ultimate goal for the commercial implementation. Such implementation-specific decisions may include, and likely are not limited to, compliance with system-related, business-related, government-related, and other constraints, which may vary by specific implementation, location, and from time to time. While a developer's efforts might be complex and time-consuming in an absolute sense, such efforts would be, nevertheless, a routine undertaking for those of skill in this art having benefit of this disclosure.

It should be understood that the implementations disclosed and taught herein are susceptible to numerous and various modifications and alternative forms. Thus, the use of a singular term, such as, but not limited to, "a" and the like, is not intended as limiting of the number of items. Also, the use of relational terms, such as, but not limited to, "top," "bottom," "left," "right," "upper," "lower," "down," "up," "side," and the like, are used in the written description for clarity in specific reference to the drawings and are not intended to limit the scope of the invention or the appended claims. For particular implementations described with reference to block diagrams and/or operational illustrations of methods, it should be understood that each block of the block diagrams and/or operational illustrations, and combinations of blocks in the block diagrams and/or operational illustrations, may be implemented by analog and/or digital hardware, and/or computer program instructions. Computer program instructions for use with or by the implementations disclosed herein may be written in an object-oriented programming language, conventional procedural programming language, or lower-level code, such as assembly language and/or microcode. The program may be executed entirely on a single processor and/or across multiple processors, as a stand-alone software package or as part of another software package. Such computer program instructions may be provided to a processor of a general-purpose computer, special-purpose computer, ASIC, and/or other programmable data processing system. The executed instructions may also create structures and functions for implementing the actions specified in the mentioned block diagrams and/or operational illustrations. In some alternate implementations, the functions/actions/structures noted in the drawings may occur out of the order noted in the block diagrams and/or operational illustrations. For example, two operations shown as occurring in succession, in fact, may be executed substantially concurrently or the operations may be executed in the reverse order, depending on the functionality/acts/structure involved.

The term "computer-readable instructions" as used above refers to any instructions that may be performed by the processor and/or other components. Similarly, the term "computer-readable medium" refers to any storage medium that may be used to store the computer-readable instructions. Such a medium may take many forms, including, but not limited to, non-volatile media, volatile media, and transmission media. Non-volatile media may include, for example, optical or magnetic disks, such as the storage device. Volatile media may include dynamic memory, such as main memory. Transmission media may include coaxial cables, copper wire, and fiber optics, including wires of the bus. Transmission media may also take the form of acoustic or light waves, such as those generated during radio frequency (RF) and infrared (IR) data communications. Common forms of computer-readable media may include, for example, a floppy disk, a flexible disk, hard disk, magnetic tape, any other magnetic medium, a CD ROM, DVD, any other optical medium, punch cards, paper tape, any other physical medium with patterns of holes, a RAM, a PROM, an EPROM, a FLASH EPROM, any other memory chip or cartridge, a carrier wave, or any other medium from which a computer can read.

In the foregoing description, for purposes of explanation and non-limitation, specific details are set forth—such as particular nodes, functional entities, techniques, protocols, standards, etc.—in order to provide an understanding of the described technology. In other instances, detailed descriptions of well-known methods, devices, techniques, etc. are omitted so as not to obscure the description with unnecessary detail. All statements reciting principles, aspects, embodiments, and implementations, as well as specific examples, are intended to encompass both structural and functional equivalents, and such equivalents include both currently known equivalents as well as equivalents developed in the future, i.e., any elements developed that perform the same function, regardless of structure. While the disclosed implementations have been described with reference to one or more particular implementations, those skilled in the art will recognize that many changes may be made thereto. Therefore, each of the foregoing implementations and obvious variations thereof is contemplated as falling within the spirit and scope of the disclosed implementations, which are set forth in the claims presented below.

COPYRIGHT NOTICE

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

What is claimed:

1. An electrolyzer assembly comprising:

a first bipolar electrolyzer comprising a first horizontal bipolar cathode upon which an electrolytic slurry may be emplaced for electrolysis, and further comprising sloped containing surfaces for containing the electrolytic slurry and a sloped gate in the sloped containing surfaces through which an end product resulting from electrolysis can be removed from the first horizontal bi-polar cathode; and a second bipolar electrolyzer comprising a second horizontal bipolar cathode, said second bipolar electrolyzer oriented vertically above the first bipolar electrolyzer such that a bottom surface of the second horizontal bipolar cathode is capable of electrically engaging an upper surface of the electrolytic slurry, said second horizontal cathode operating as an active anode for electrolysis of the electrolytic slurry.

2. The electrolyzer assembly of claim 1, wherein the sloped containing surfaces permit the second horizontal bipolar cathode to electrically engage the upper surface of the electrolytic slurry.

3. The electrolyzer assembly of claim 1, further comprising at least one additional bipolar electrolyzer each comprising an additional horizontal bipolar cathode.

4. The electrolyzer assembly of claim 1, wherein the first bipolar electrolyzer further comprises a removing mechanism for removing, from the horizontal cathode, an end product resulting from electrolysis.

5. The electrolyzer assembly of claim 1, further comprising a third horizontal bipolar electrolyzer comprising a third horizontal bipolar cathode, said third bipolar electrolyzer oriented vertically above the second bipolar electrolyzer, said third horizontal cathode capable of operating as an active anode for electrolysis of a second electrolytic slurry emplaced upon the second bipolar cathode.

6. The electrolyzer assembly of claim 1, further comprising an anode suspended above the second horizontal bipolar cathode for physically engaging a second electrolytic slurry contained by the second bipolar electrolyzer.

7. The electrolyzer assembly of claim 1, further comprising a special electrolyzer oriented vertically below the first electrolyzer, said special electrolyzer comprising a uni-polar horizontal cathode oriented to operate with the first horizontal bipolar cathode for performing electrolysis.

8. The electrolyzer assembly of claim 1, wherein the second bipolar electrolyzer further comprises a venting substructure through which gaseous compounds resulting from electrolysis as the active anode for the first bipolar electrolyzer may pass.

9. The electrolyzer assembly of claim 1, further comprising a direct current electrical supply and a power controller for controlling a current during electrolysis at one or more levels at one or more time periods during electrolysis.

10. The electrolyzer assembly of claim 1, wherein the second horizontal bipolar cathode is suspended substantially parallel to the first horizontal bipolar cathode and between 40 mm to 140 mm above the first horizontal bipolar cathode during electrolysis.

11. The electrolyzer assembly of claim 1, further comprising a slurry line for emplacing the electrolytic slurry onto the first horizontal bipolar cathode.

12. The electrolyzer assembly of claim 1, further comprising a slurry line for emplacing the electrolytic slurry onto the second horizontal bipolar cathode.

13. An apparatus for performing electrolysis comprising:

a first horizontal bipolar cathode having a surface onto which an electrolytic slurry may be emplaced for electrolysis; and a second horizontal bipolar cathode suspended above the first horizontal bipolar cathode and comprising a horizontal surface for physically engaging an upper surface of the electrolytic slurry for electrolysis in which the second horizontal bipolar cathode functions as an active anode with regard to the first horizontal bipolar cathode during electrolysis;

wherein the first horizontal bipolar cathode and the second horizontal bipolar cathode each further comprise sloped containing surfaces and a sloped gate in the sloped containing surfaces through which end products resulting from electrolysis can be removed from the first horizontal bipolar cathode and the second horizontal bipolar cathode.

14. The apparatus of claim 13, further comprising a removing mechanism for removing, from the first horizontal bipolar cathode, an end product resulting from electrolysis.

15. The apparatus of claim 13, wherein the second horizontal bipolar cathode comprises a venting substructure through which gaseous compounds resulting from electrolysis may pass.

16. The apparatus of claim 13, wherein the second horizontal bipolar cathode is between 40 mm and 140 mm above the first horizontal bipolar cathode during electrolysis.

17. A system for performing electrolysis on an electrolytic slurry comprising:

a first horizontal bipolar cathode having a surface onto which the electrolytic slurry may be emplaced for electrolysis, and further comprising containing surfaces for containing the electrolytic slurry and a gate in the containing surfaces through which an end product resulting from electrolysis can be removed from the first horizontal bipolar cathode; and a second horizontal bipolar cathode electrically engaging the electrolytic slurry for electrolysis, the a second horizontal bipolar cathode suspended above the first horizontal bipolar cathode and comprising a horizontal surface for physically engaging an upper surface of the electrolytic slurry for electrolysis, wherein the second horizontal bipolar cathode functions as an active anode with regard to the first horizontal bipolar cathode during electrolysis.

18. The electrolyzer of claim 17, wherein the horizontal anode surface comprises a venting substructure through which gaseous compounds resulting from electrolysis may pass.

19. The electrolyzer of claim 17, further comprising a removing mechanism for removing, from the first horizontal bipolar cathode, an end product resulting from electrolysis.

20. The electrolyzer of claim 17, further comprising a slurry line for emplacing the electrolytic slurry onto the first horizontal bipolar cathode.

* * * * *